US006663358B2

(12) United States Patent
Loprete et al.

(10) Patent No.: US 6,663,358 B2
(45) Date of Patent: Dec. 16, 2003

(54) COMPRESSORS FOR PROVIDING AUTOMATIC CAPACITY MODULATION AND HEAT EXCHANGING SYSTEM INCLUDING THE SAME

(75) Inventors: Joe Frank Loprete, Bristol, TN (US); David Turner Monk, Bristol, VA (US); Eugene Karl Chumley, Abindon, VA (US); Tyrone Scott Simerly, Johnson City, TN (US); John K. Narney, II, Bristol, VA (US); Mark Randall Trent, Bristol, VA (US); Panteleimon V. Hatzikazakis, Kingsport, TN (US); Tom Evans Goodnight, Williston, SC (US); Rongchang Xin, Bristol, VA (US); Robert Desmond Douglas, Bristol, VA (US)

(73) Assignee: Bristol Compressors, Inc., Bristol, VA (US)

( * ) Notice: Subject to any disclaimer, the term of this patent is extended or adjusted under 35 U.S.C. 154(b) by 0 days.

(21) Appl. No.: 10/058,147

(22) Filed: Jan. 29, 2002

(65) Prior Publication Data

US 2002/0187057 A1 Dec. 12, 2002

Related U.S. Application Data

(63) Continuation-in-part of application No. 09/877,146, filed on Jun. 11, 2001.

(51) Int. Cl.[7] ..... F04B 23/00; F04B 49/00

(52) U.S. Cl. ..... 417/313; 417/310; 417/299; 417/283

(58) Field of Search ..... 417/313, 310, 417/299, 283, 44.1, 42

(56) References Cited

U.S. PATENT DOCUMENTS

| | | | |
|---|---|---|---|
| 2,497,677 A | 2/1950 | Lathrop | 62/212 |
| 3,023,591 A | 3/1962 | Tilney | 62/204 |
| 3,360,952 A | 1/1968 | Lewis | 417/307 |
| 3,710,586 A | 1/1973 | Maudlin | 62/216 |

(List continued on next page.)

OTHER PUBLICATIONS

1998 Standard for "Water Chilling Packages Using the Vapor Compression Cycle", Standard 550/590, Air–Conditioning & Refrigeration Institute, pp. 1–29 (1998). month of publication not provided.

Communication from European Patent Office (mailing date of May 16, 2003) including a Search Report citing the documents listed above.

*Primary Examiner*—Cheryl J. Tyler
*Assistant Examiner*—Michael K. Gray
(74) *Attorney, Agent, or Firm*—Finnegan, Henderson, Farabow, Garrett & Dunner, L.L.P.

(57) ABSTRACT

A compressor for providing automatic capacity modulation is disclosed. The compressor comprises a compression chamber, a compressing member, a reexpansion area, a flow passage, a valve member, and a biasing member. The flow passage is in fluid communication with the compression chamber and the reexpansion area. In one position, the valve member permits flow through the flow passage and in a second position it prevents flow. The valve member is subjected to a first operating condition of fluid on one side and a second operating condition of the fluid on the other side. The biasing member exerts a biasing force on the valve member. When the first operating condition reaches a predetermined point relative to the second operating condition, the valve member moves and effects a change in the capacity of the compressor.

73 Claims, 24 Drawing Sheets

U.S. PATENT DOCUMENTS

| | | | | | |
|---|---|---|---|---|---|
| 3,767,328 | A | * | 10/1973 | Ladusaw | 417/310 |
| 3,951,569 | A | | 4/1976 | Jacobs | 417/269 |
| 3,977,205 | A | | 8/1976 | Dreisziger et al. | 62/117 |
| 4,258,553 | A | | 3/1981 | Kelly et al. | 62/117 |
| 4,373,352 | A | | 2/1983 | Ladusaw | 417/310 |
| 4,385,872 | A | | 5/1983 | Anderson | 417/571 |
| 4,427,346 | A | | 1/1984 | Romer | 417/292 |
| 4,438,635 | A | | 3/1984 | McCoy, Jr. | 62/305 |
| 4,558,993 | A | | 12/1985 | Hori et al. | 417/283 |
| 4,646,535 | A | | 3/1987 | Matsuoka et al. | 62/228.5 |
| 4,679,404 | A | | 7/1987 | Alsenz | 62/175 |
| 4,685,489 | A | | 8/1987 | Yun et al. | 417/274 |
| 4,744,733 | A | | 5/1988 | Terauchi et al. | 417/310 |
| 4,798,057 | A | | 1/1989 | Okamoto et al. | 62/228.3 |
| 5,049,040 | A | | 9/1991 | Diab et al. | 417/274 |
| 5,141,420 | A | | 8/1992 | Nambiar | 418/55.1 |
| 5,228,308 | A | | 7/1993 | Day et al. | 62/198 |
| 5,289,692 | A | | 3/1994 | Campbell et al. | 62/181 |
| 5,315,841 | A | | 5/1994 | Inoue | 62/228.3 |
| 5,499,505 | A | | 3/1996 | Gistau-Baguer | 62/608 |
| 5,715,693 | A | | 2/1998 | van der Walt et al. | 62/198 |
| 5,735,675 | A | | 4/1998 | Peoples et al. | 417/314 |
| 6,079,952 | A | | 6/2000 | Harte et al. | 417/253 |
| 6,099,259 | A | * | 8/2000 | Monk et al. | 417/15 |
| 6,138,467 | A | * | 10/2000 | Lifson et al. | 62/217 |
| 6,176,685 | B1 | | 1/2001 | Iizuka et al. | 417/310 |
| 6,238,188 | B1 | * | 5/2001 | Lifson | 417/42 |

* cited by examiner

COMPRESSORS FOR PROVIDING AUTOMATIC CAPACITY MODULATION AND HEAT EXCHANGING SYSTEM INCLUDING THE SAME

RELATED APPLICATIONS

The present application is a continuation-in-part of application Ser. No. 09/877,146 filed on Jun. 11, 2001, which is incorporated herein by reference.

BACKGROUND OF THE INVENTION

The present invention relates generally to compressors for providing capacity modulation. More particularly, the present invention relates to compressors for providing automatic capacity modulation without any need for external controls, a heat exchanging system including the same, and related capacity modulation methods.

Heat exchanging systems, including air-conditioning, refrigeration, and heat-pump systems, utilize compressors to increase the pressure of the fluid flowing through the systems. In response to varying cooling or heating demands, some of these heat exchanging systems modulate their system capacity by varying the capacity of the compressors. These compressors, however, typically rely on external controls for capacity modulation, and therefore, are costly because of additional components required for the external controls.

SUMMARY OF THE INVENTION

Accordingly, the present invention is directed to improved compressors for providing automatic capacity modulation. The invention is also directed to a heat exchanging system including the improved compressor, and to related capacity modulation methods. The advantages and purposes of the invention will be set forth in part in the description which follows, and in part will be obvious from the description, or may be learned by practice of the invention. The advantages and purposes of the invention will be realized and attained by the elements and combinations particularly pointed out in the appended claims.

To attain the advantages and in accordance with the purposes of the invention, as embodied and broadly described herein, the invention is directed to a variable compressor comprising a compression chamber, a reexpansion area, a flow channel, a valve member, and a control. The flow channel is between the compression chamber and the reexpansion area. The valve member is movable between first and second positions. The valve member in a first position allows flow between the compression chamber and the reexpansion area and in a second position prevents flow between the compression chamber and the reexpansion area, whereby the compressor operates at a first capacity when the valve member is in the first position and at a second, increased capacity when the valve member is in the second position. The control is associated only with the compressor and moves the valve member between the first and second positions as a function of an operating parameter of the compressor, whereby the compressor is automatically modulated based on the operating parameter.

In another aspect, the invention is directed to a compressor comprising a compression chamber, a compressing member, a flow passage, a valve member, and a biasing member. The compressing member is movable to compress fluid entering the compression chamber. The flow passage is in fluid communication with the compression chamber at one end and a reexpansion area at the other end. The valve member is associated with the flow passage and is movable between a first position permitting flow through the flow passage and a second position preventing flow through the flow passage. The valve member is continuously subjected to a first operating condition of the fluid such that a first force is continuously exerted on the valve member in a first direction. The valve member is also continuously subjected to a second operating condition of the fluid such that a second force is continuously exerted on the valve member in a second direction opposite to the first direction. The biasing member exerts a biasing force on the valve member in the second direction such that when the first force overcomes the biasing force and the second force combined together, the valve member moves from the first position to the second position and modulates the capacity of the compressor.

In yet another aspect, the invention is directed to a heat exchanging system having fluid flowing therethrough in a cycle. The heat exchanging system comprises a condenser, an expansion device, an evaporator, a compressor, and a control. The expansion device is in fluid communication with the condenser. The evaporator is in fluid communication with the expansion device. The compressor is in fluid communication with the evaporator and the condenser. The compressor includes an actuating element. The actuating element is movable between a first position and a second position as a function of an operating parameter of the compressor, such that the compressor operates at a first capacity when the actuating element is in a first position and at a second capacity when the actuating element is in the second position. The control turns the compressor on or off, based on the demand for heating or cooling.

In yet another aspect, the invention is directed to a method of operating a variable capacity compressor. The method comprises the steps of: operating the compressor at a first capacity; applying first and second pressures continuously to a movable component in the compressor, the movable component causing the compressor to operate at the first capacity when the movable component is in a first position and at a second increased capacity when the movable component is in a second position; and applying a biasing force to bias the movable component toward the first position, such that the movable component moves to the second position when the relative differential between the first and second pressures reaches a predetermined value, whereby the compressor automatically modulates its capacity based on the relative values of the first and second pressures.

In yet another aspect, the invention is directed to a capacity modulation method. The capacity modulation method comprises the steps of: providing a compressor comprising a compression chamber and a compressing member movable to compress fluid entering the compression chamber; providing a flow passage in fluid communication with the compression chamber at one end and a reexpansion area at the other end; providing a valve member associated with the flow passage and movable between a first position permitting flow through the flow passage and a second position preventing flow through the flow passage; subjecting the valve member continuously to a first operating condition of the fluid such that a first force is continuously exerted on the valve member in a first direction; subjecting the valve member continuously to a second operating condition of the fluid such that a second force is continuously exerted on the valve member in a second direction opposite to the first direction; and exerting a biasing force on the valve member in the second direction such that when the first force overcomes the second force and the biasing force combined together, the valve member moves from the first position to the second position and thereby modulates the capacity.

It is to be understood that both the foregoing general description and the following detailed description are exemplary and explanatory only and are not restrictive of the invention, as claimed.

BRIEF DESCRIPTION OF THE DRAWING

The accompanying drawings, which are incorporated in and constitute a part of this specification, illustrate embodiments of the invention and, together with the description, serve to explain the principles of the invention. In the drawings.

In FIG. 8, a valve member of the present invention is shown to be positioned within a reexpansion chamber and in a position to permit flow through a flow passage in fluid communication with a compression chamber and the reexpansion chamber;

In FIG. 10, a valve member of the present invention is shown to be positioned within a valve chamber and in a position to permit flow through a flow passage in fluid communication with a compression chamber and the reexpansion chamber;

In FIG. 12, a valve member of the present invention is shown to be in a position to permit flow through a flow passage in fluid communication with a compression chamber and a suction channel;

In FIG. 17, a valve member of the present invention is shown to be in a position to permit flow through a flow passage in fluid communication with a compression chamber and a suction channel;

In FIG. 19, a temperature element is applied to a valve member of the present invention and the valve member is shown to be in a position to permit flow through a flow passage in fluid communication with a compression chamber and a suction channel;

In FIG. 21, the valve member is shown to be in a position to permit flow through a flow passage in fluid communication with a compression chamber and a suction channel;

In FIG. 23, the valve member is shown to be in a position to permit flow through a flow passage in fluid communication with a compression chamber and a suction channel;

In FIG. 25, the valve member is shown to be in a position to permit flow through a flow passage in fluid communication with a compression chamber and a suction channel;

In FIG. 27, a temperature element applied to a valve member of the present invention is shown to be not exposed to fluid. The valve member is shown to be in a position to permit flow through a flow passage in fluid communication with a compression chamber and a suction channel.

DETAILED DESCRIPTION

Reference will now be made in detail to the presently preferred embodiments of the present invention, examples of which are illustrated in the accompanying drawings. Wherever possible, the same reference numbers will be used throughout the drawings to refer to the same or like parts.

Figure 7:
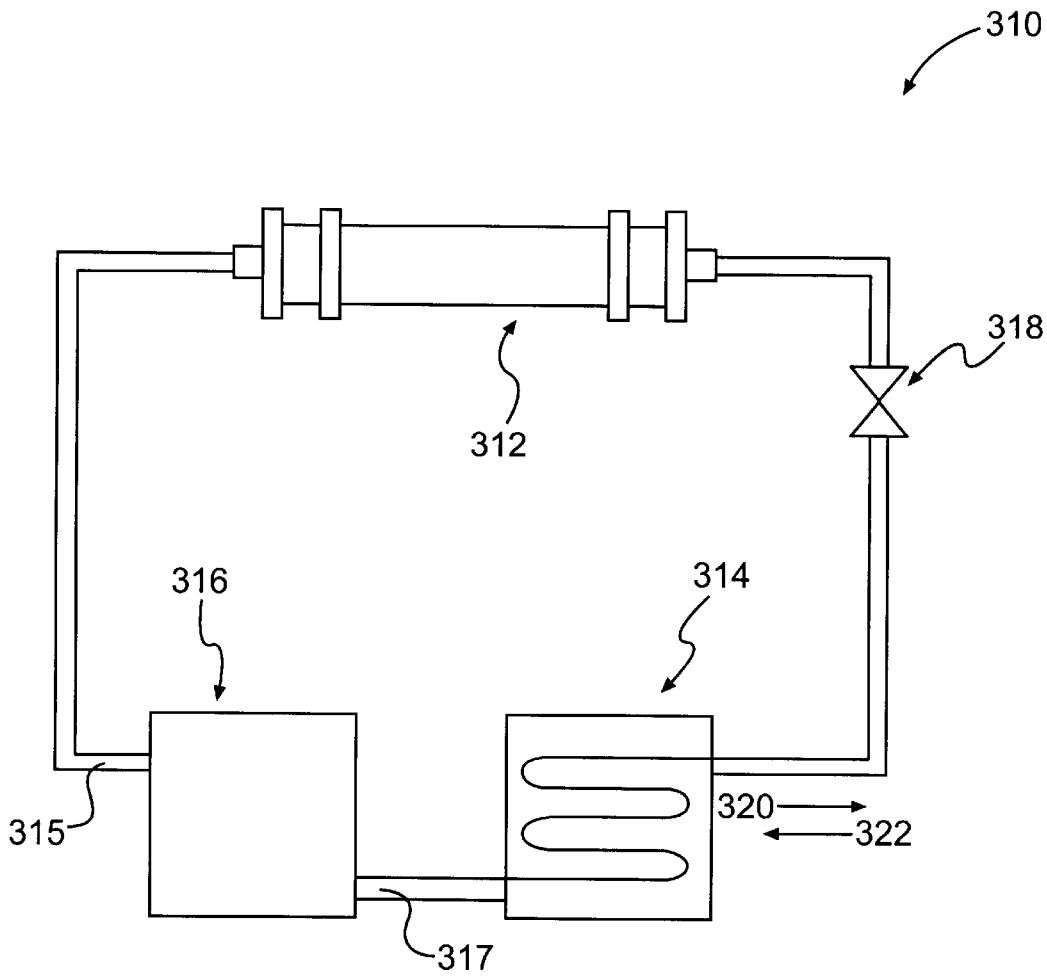
FIG. 7 is a schematic diagram of a heat exchanging system, such as an air-conditioning, refrigeration, or heat-pump system, having a compressor for providing capacity modulation in accordance with the invention.

In accordance with the present invention and illustrated in FIG. 7, a heat exchanging system 310, such as a Heating, Ventilation, and Air-Conditioning (HVAC) or refrigeration system, includes two heat exchangers 312 and 314, a compressor 316, and an expansion device 318. Tubes or pipes connect the heat exchangers 312 and 314, the compressor 316, and the expansion device 318. Fluid at a given pressure flows through the heat exchanger 314, conventionally called a condenser. While flowing through the condenser 314, the fluid loses heat. The fluid then flows through the expansion device 318 where its pressure decreases to another level. The fluid then flows through the heat exchanger 312, conventionally called an evaporator. While flowing though the evaporator 312, the fluid absorbs heat. Finally, the fluid flows through the compressor 316 where its pressure increases back to the original level. Thus, the fluid flowing through the heat exchanging system 310 forms a cycle. The heat exchangers 312 and 314 are respectively called an evaporator and a condenser because at least a portion of the fluid undergoes a phase change while flowing though them. At least a portion of the fluid changes from liquid to vapor in the evaporator 312 while at least a portion of the fluid changes from vapor to liquid in the condenser 314.

Because the fluid flowing through the evaporator 312 absorbs heat, an air-conditioning or refrigeration system results if the evaporator 312 is placed in a space to be cooled. On the other hand, because the fluid flowing through the condenser 314 loses heat, a heat-pump system results if the condenser 314 is placed in a space to be heated. The evaporator 312 and condenser 314 may directly cool or heat a space through air inside). Alternatively, the evaporator 312 and condenser 314 may exchange heat with other heat transfer fluids (e.g., water), which in turn will either cool or heat a space through another heat transfer mechanism.

Furthermore, a system that exchanges heat directly with outside air can serve as both an air-conditioning or refrigeration system and a heat-pump system. For example, during the summer, the heat exchanging system 310 shown in FIG. 7 may serve as an air-conditioning or refrigeration system where the evaporator 312 cools inside air by absorbing heat while the condenser 314 rejects heat to outside air. In this air-conditioning or refrigeration system, the fluid flows in a direction designated by the reference number 320. The reference numbers 315 and 317 respectively designate a suction line in fluid communication with the evaporator 312 and a discharge line in fluid communication with the condenser 317 in this air-conditioning or refrigeration system. During the winter, on the other hand, the flow of the fluid may be reversed as designated by the reference number 322 to transform the air-conditioning or refrigeration system into a heat-pump system. In this heat-pump system, the heat exchanger 312 becomes a condenser, which warms the inside air by rejecting heat thereto, while the heat exchanger 314 becomes an evaporator, which absorbs heat from the outside air. In this heat-pump system, the reference numbers 315 and 317 respectively designate a discharge line in fluid communication with the condenser 312 and a suction line in fluid communication with the evaporator 314.

In accordance with the present invention, the heat exchanging system 310 can modulate its capacity in response to changes in system parameters (e.g., changes in condenser pressure or temperature) or changes in cooling or heating requirements. In other words, the heat exchanging system 310 adjusts its cooling or heating capacity by adjusting the amount of fluid flowing through the system. As described in greater detail below, the compressor 316 of the present invention can automatically modulate its capacity based on changing parameters of the compressor that are in turn applied to change an operating characteristic of the compressor. This automatic modulation of the compressor thereby can affect and modulate the capacity of the heat exchanging system 310 without any need for external controls. Thus, the self-modulating compressor of the present invention can be used in an HVAC system and will self-modulate its capacity as parameters, such as the outside air temperature, change. In such an HVAC system, the compressor can be turned on and off by a standard thermostat control, whenever the desired temperature falls above or below the selected set temperature. Once the compressor is turned on, it will self modulate, depending on the working parameters of the system.

The embodiment shown in FIGS. 1–6 illustrates a capacity modulation system 10 of the present invention utilizing a rotary or swing-link compressor 12 of the type used in an air-conditioning or refrigeration system. As described below, however, the capacity modulation system and methods of the present invention can also be incorporated into other types of compressors. Also, the capacity modulation system could be effectively applied in other heat exchanging systems, such as a heat-pump system.

Figure 1:
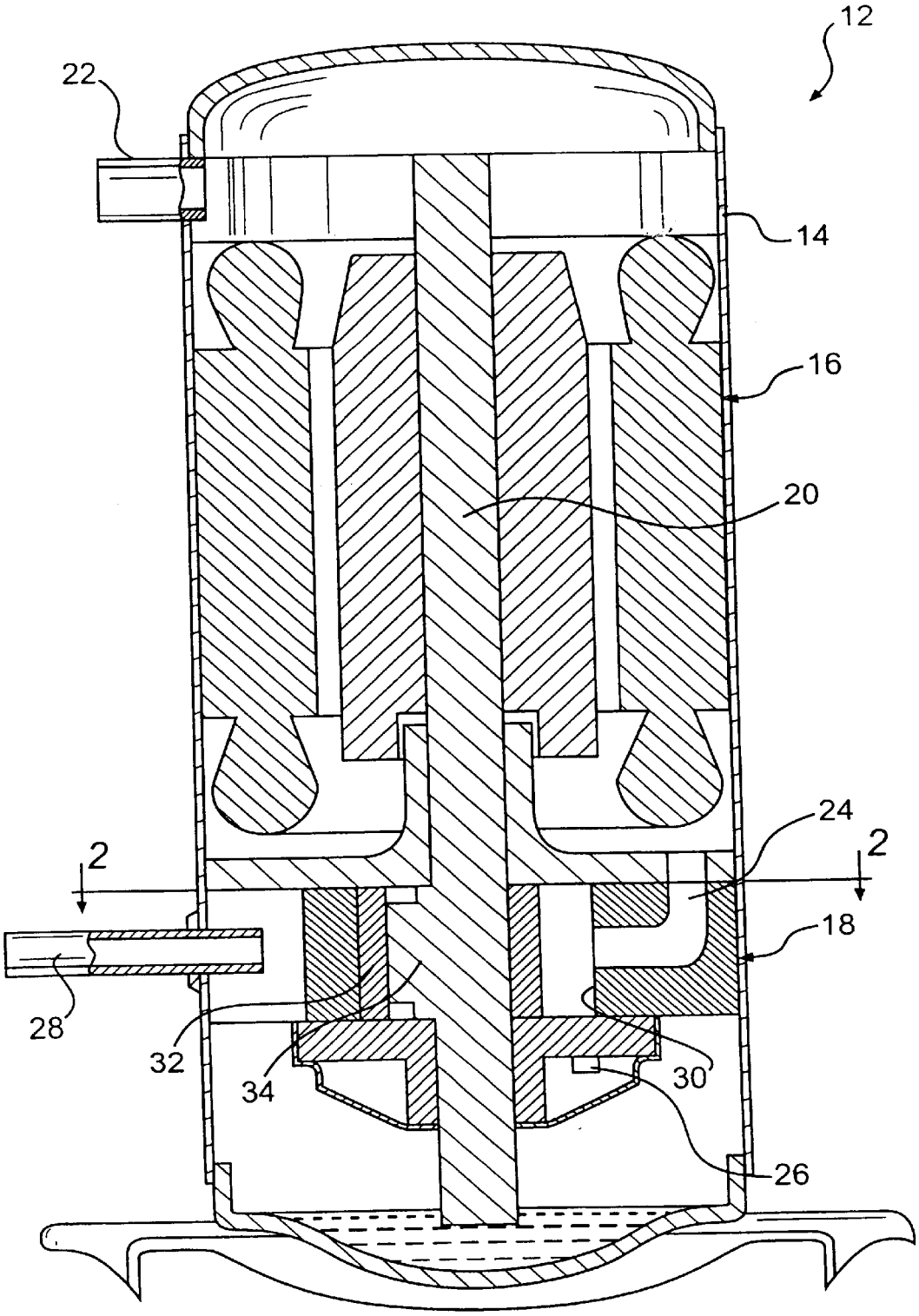
FIG. 1 is a sectional view of a compressor incorporating one embodiment of the capacity modulation system of the present invention.

As shown in FIG. 1, the compressor 12 includes a housing 14, a motor 16, and a rotary compressor unit 18. The motor 16 turns a shaft 20, which operates the compressor unit 18.

In operation, the compressor unit 18 draws fluid, such as refrigerant, into the housing 14 through an inlet 22, at suction pressure through the suction line 315 shown in FIG. 7. In the compressor shown in FIG. 1, the inlet is proximate to the motor 16, and the refrigerant cools the motor 16 as it flows to the compressor unit 18. Alternatively, the inlet 22 can be positioned proximate to the compressor unit 18 in such a manner that the refrigerant does not flow past the motor 16, but instead is applied directly to the compressor unit 18.

The fluid then passes through the suction channel 24 and enters the compressor unit 18, where it is compressed. The compressed fluid leaves the compressor unit 18 at discharge pressure through the discharge channel 26, then passes out of the housing 14 through the outlet 28 to the discharge line 317 shown in FIG. 7.

The fluid is compressed within the compressor unit 18 in a substantially cylindrical compression chamber 30 shown in FIGS. 2–5. The rotatable shaft 20 is disposed within the compression chamber 30. A cylindrical roller or piston 32 is eccentrically disposed on the shaft 20 within the compression chamber 30 such that it contacts a wall of the compression chamber 30 as the shaft 20 rotates. The roller 32 is free to rotate on an eccentric or crank 34 that is secured to or integral with the shaft 20. The roller or piston 32 can be any of the types used in conventional rotary or swing link compressors.

In the rotary compressor shown in FIGS. 2–5, a partition, or vane 36, is disposed between the wall of the compression chamber 30 and the roller 32 to define a low pressure portion 38 and a high pressure portion 40 within the compression chamber 30. As the shaft 20 and the roller 32 rotate from the position shown in FIG. 2, the low pressure portion 38 increases in size as the high pressure portion 40 decreases in size. As a result, the fluid in the high pressure portion 40 is compressed and exits through the discharge port 44.

The vane 36 must be kept in close contact with the roller 32 as the roller 32 moves along the circumference of the compression chamber 30 to insure that the fluid being compressed does not leak back to the low pressure portion 38. The vane 36 can be spring biased towards the roller 32, allowing the vane 36 to follow the roller 32 as it moves. Alternatively, the vane 36 can be integral with the roller 32. Compressors having an integral vane and roller are known as "swing link" compressors.

The suction channel 24, shown in FIGS. 1–5, is in fluid communication with the low pressure portion 38 to provide fluid to the compression chamber 30 at suction pressure. As shown in FIGS. 2–5, the suction channel 24 forms a suction inlet 42 in the wall of the compression chamber 30 adjacent to the vane 36 in the low pressure portion 38.

The discharge channel 26, shown in FIGS. 1–5, is in fluid communication with the high pressure portion 40 to remove fluid from the compression chamber 30 at discharge pressure. The discharge channel 26 forms a discharge outlet 44 in the wall of the compression chamber 30 adjacent to the vane 36 in the high pressure portion 40, as shown in FIGS. 2–5.

Two embodiments of the capacity modulation system 10 of the present invention are shown in FIGS. 2–5. In both embodiments, a reexpansion chamber 50 is provided adjacent to the compression chamber 30, with a reexpansion channel 46 providing a flow path between the compression chamber 30 and the reexpansion chamber 50. The reexpansion channel 46 forms a reexpansion port 48 in the wall of the compression chamber.

The reexpansion chamber 50 can be arranged in locations proximate to the compression chamber 30 and is sized to provide a desired modulation of the compressor capacity, as explained in more detail below. Larger reexpansion chambers will modulate the change in capacity more than will smaller reexpansion chambers. In preferred embodiments, the reexpansion chamber 50 should be sized sufficient to cause the compressor to operate at a lower capacity of 70 to 90% relative to its highest capacity when the reexpansion chamber 50 is closed off from the compression chamber. By means of example only, the reexpansion chamber 50 can be machined as a recess in the cylinder block opposite the compression chamber 30 and connected with the compression chamber 30 by a drilled channel. The open recess can then be enclosed by a cap of the compressor, to provide a sealed reexpansion chamber 50.

As shown in FIGS. 2–5, the reexpansion chamber 50 is connected with a portion of the reexpansion channel 46. Further, a valve 52 is disposed in the reexpansion channel 46. The valve 52 is movable between a first position, shown in FIGS. 2 and 4, and a second position, shown in FIGS. 3 and 5.

In the first position, the valve 52 allows fluid to flow between the compression chamber 30 and the reexpansion chamber 50. As described below, the compressor 12 operates in a reduced capacity mode when the valve 52 is in the first position. In the second position, the valve 52 prevents fluid communication between the compression chamber 30 and the reexpansion chamber 50. As described below, the compressor 12 operates in a full capacity mode when the valve 52 is in the second position. Thus, the valve 52 selectively allows or prevents fluid communication between the compression chamber 30 and the reexpansion chamber 50.

Figure 2:
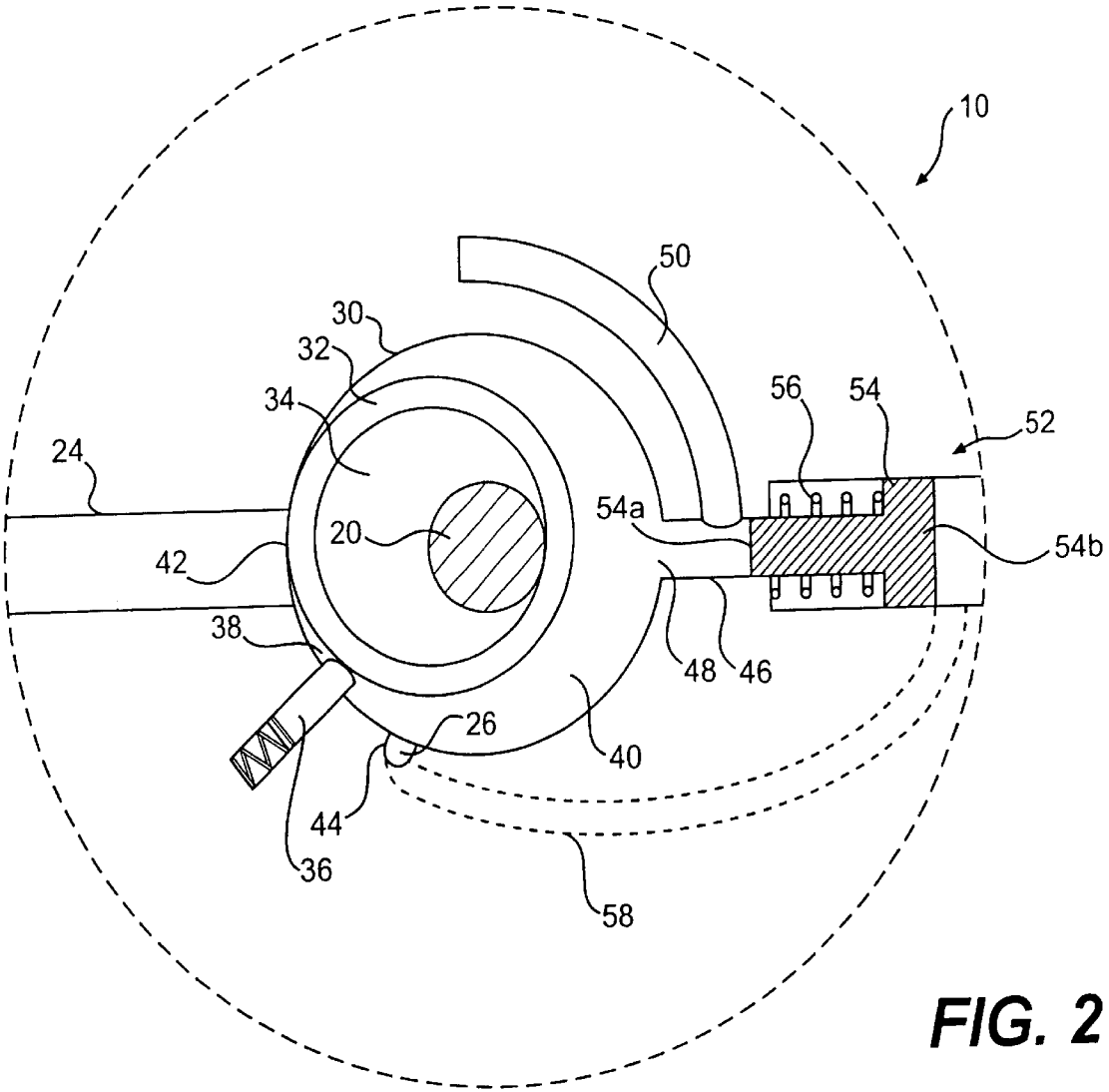
FIG. 2 is a partial sectional view on line 2—2 of FIG. 1, showing one embodiment of the capacity modulation system of the present invention in a reduced capacity mode.
Figure 3:
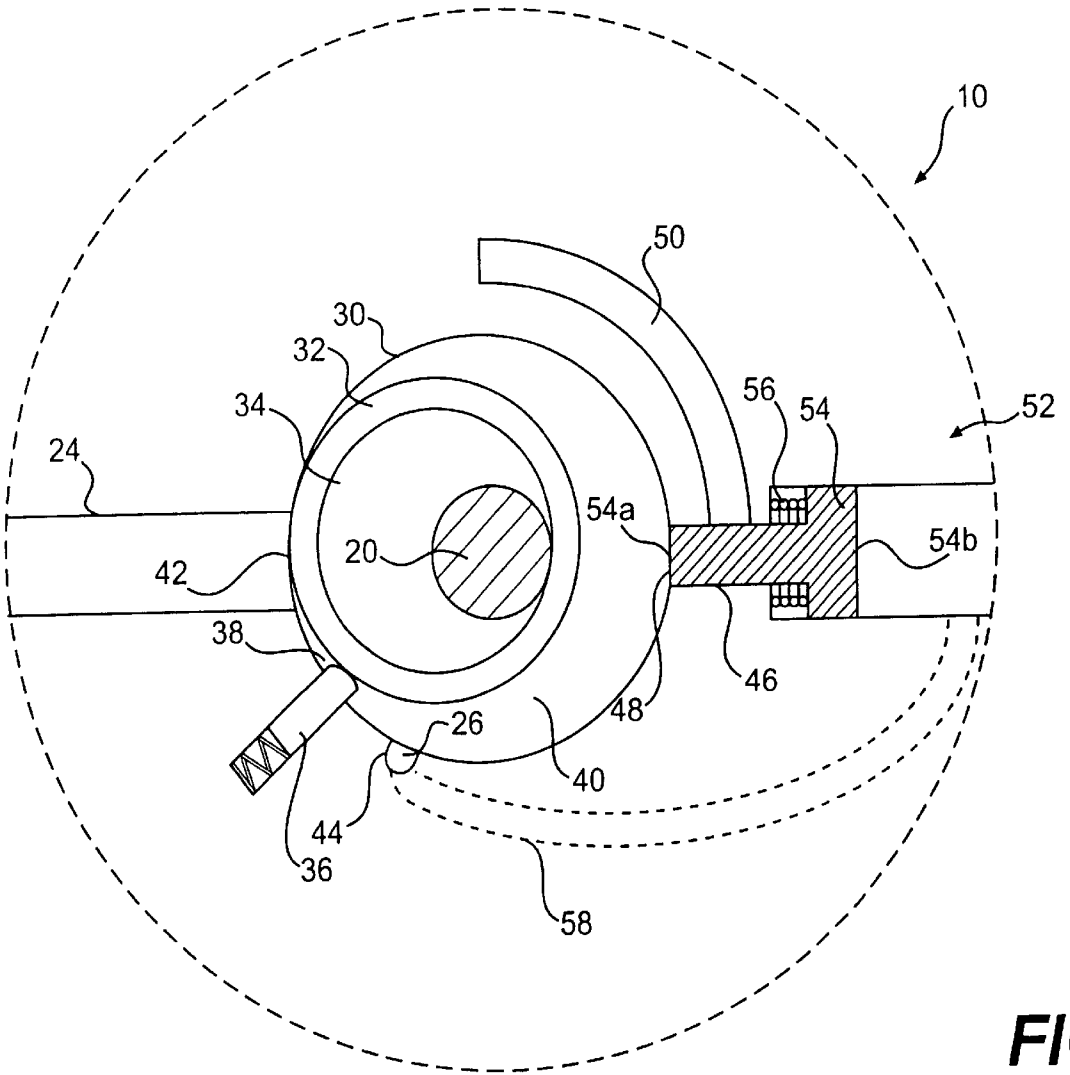
FIG. 3 is a partial sectional view on line 2—2 of FIG. 1, showing the embodiment of the capacity modulation system of the present invention shown in FIG. 1 in a full capacity mode.

In the embodiment of the capacity modulation system 10 shown in FIGS. 2 and 3, the valve 52 comprises a sliding element 54 biased to the first position by a coil spring 56. The sliding element 54 has a forward surface **54*a* and a rear surface 54*b*. A discharge feed line 58 extends from the discharge channel 26 to the reexpansion channel 46 to expose the rear surface 54*b* of the sliding element 54** to fluid at discharge pressure.

When the compressor 12 is initially activated, it is in the reduced capacity mode shown in FIG. 2. The compression cycle begins as fluid enters the low pressure portion 38 of the compression chamber 30 through the suction channel 24 in advance of the roller 32.

As the roller 32 proceeds along the inner circumference of the compression chamber 30, the fluid is compressed. Some of this compressed fluid flows through the reexpansion port 48, along the reexpansion channel 46, and into the reexpansion chamber 50. When the roller 32 passes the reexpansion port 48, the fluid in the reexpansion chamber 50 expands back to the low pressure portion 38 of the compression chamber 30. Some of this fluid flows back through the suction port 42 into the suction channel 24 until the fluid is at or close to the suction pressure. The remaining fluid in the high pressure portion 40 is further compressed until it is discharged from the compression chamber 30 through the discharge port 44.

Thus, in this mode, not all of the fluid that enters the compression chamber 30 exits through the discharge port 44. A certain volume of fluid, which is dependent upon the volume of the reexpansion chamber 50, is allowed to return to the compression chamber 30. Because not all of the fluid exits the compressor 12, this operational mode is referred to as the reduced capacity mode.

The degree of capacity reduction is determined by a variety of factors, including the volume of the reexpansion chamber 50 and the location of the reexpansion port 48 relative to the suction port 42. Generally, increasing the volume of the reexpansion chamber 50 provides a greater reduction in the capacity of the compressor 12. Similarly, locating the reexpansion port 48 farther from the suction port 42 along the roller's path also provides a greater reduction in capacity. Ultimately, the optimum volume of the reexpansion chamber 50 and location of the reexpansion port 42 for a given application can be determined by a combination of analytical calculations and empirical testing.

Referring again to FIG. 2, as the compressor 12 continues to operate, the discharge pressure slowly increases. The force of the fluid on the rear surface **54*b* of the sliding element 54 acts against the biasing force of the spring 56 and the force acting on the forward surface 54*a* of the sliding element 54. The forward surface of 54*a* is exposed to either the fluid in the low pressure portion 38 or the fluid in the high pressure portion 40. Accordingly, the forward surface of 54***a* is exposed to at least the suction pressure. In other words, the pressure acting on the forward surface 54*a* of the sliding element 54 varies from the suction pressure and an intermediate pressure achieved in the high pressure portion 40 when the roller 32 reaches the reexpansion port 48. Eventually, the discharge pressure reaches a predetermined level and overcomes the combined force of the spring force and the force exerted on the forward surface 54*a*, causing the sliding element 54 to move to the second position, corresponding to the full capacity mode of the compressor 12. The predetermined discharge pressure level can be varied by using a biasing means having a different spring constant. The valve 52 of this embodiment, therefore, operates in response to a parameter internal to the compressor 12. Again, the design of the valve 52 and the selection of a spring 56 for a specific system can be determined through empirical testing.

FIG. 3 shows the compressor 12 of this embodiment in the full capacity mode. As shown, the forward surface 54*a* of the sliding element 54 is substantially flush with the wall of the compression chamber 30. Here, as the roller 32 proceeds around the compression chamber 30, all of the fluid in the low pressure section 38 is compressed until it is discharged through the discharge port 44. Thus, in the full capacity mode, each compression stroke of the roller 32 produces a larger volume of high pressure fluid. In this embodiment, the rotary or swing link compressor will operate at the full capacity, in the same manner as conventional rotary and swing link compressors.

Although the valve 52 of this embodiment has been described as being a piston-type valve 52 biased with a coil spring 56, it is noted that other equivalent valve members and biasing devices are considered within the scope of the invention. Examples of suitable biasing means include torsion springs, coil springs, and other springs and elastic elements.

Figure 4:
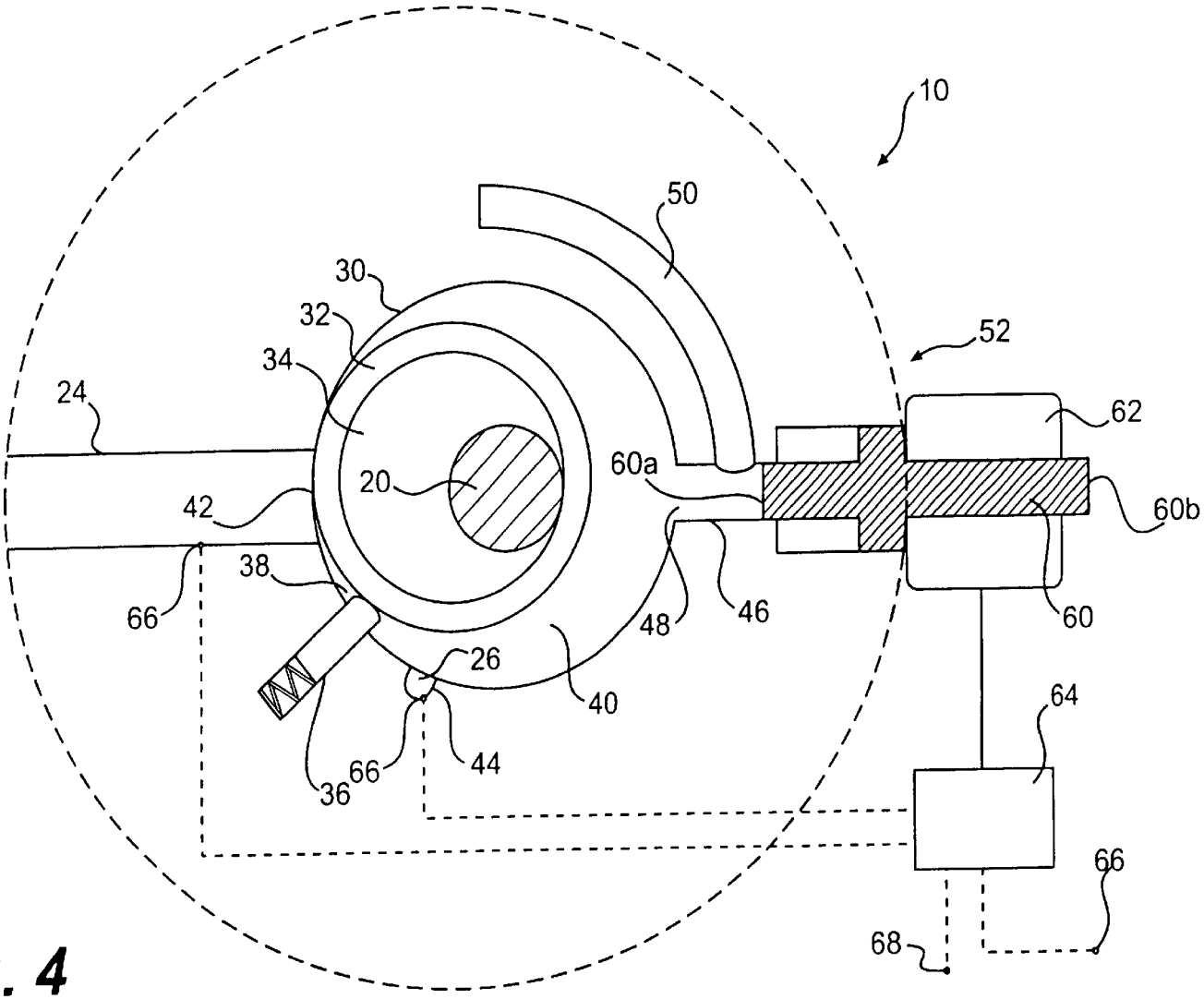
FIG. 4 is a partially schematic partial sectional view on line 2—2 of FIG. 1, showing another embodiment of the capacity modulation system of the present invention in a reduced capacity mode.
Figure 5:
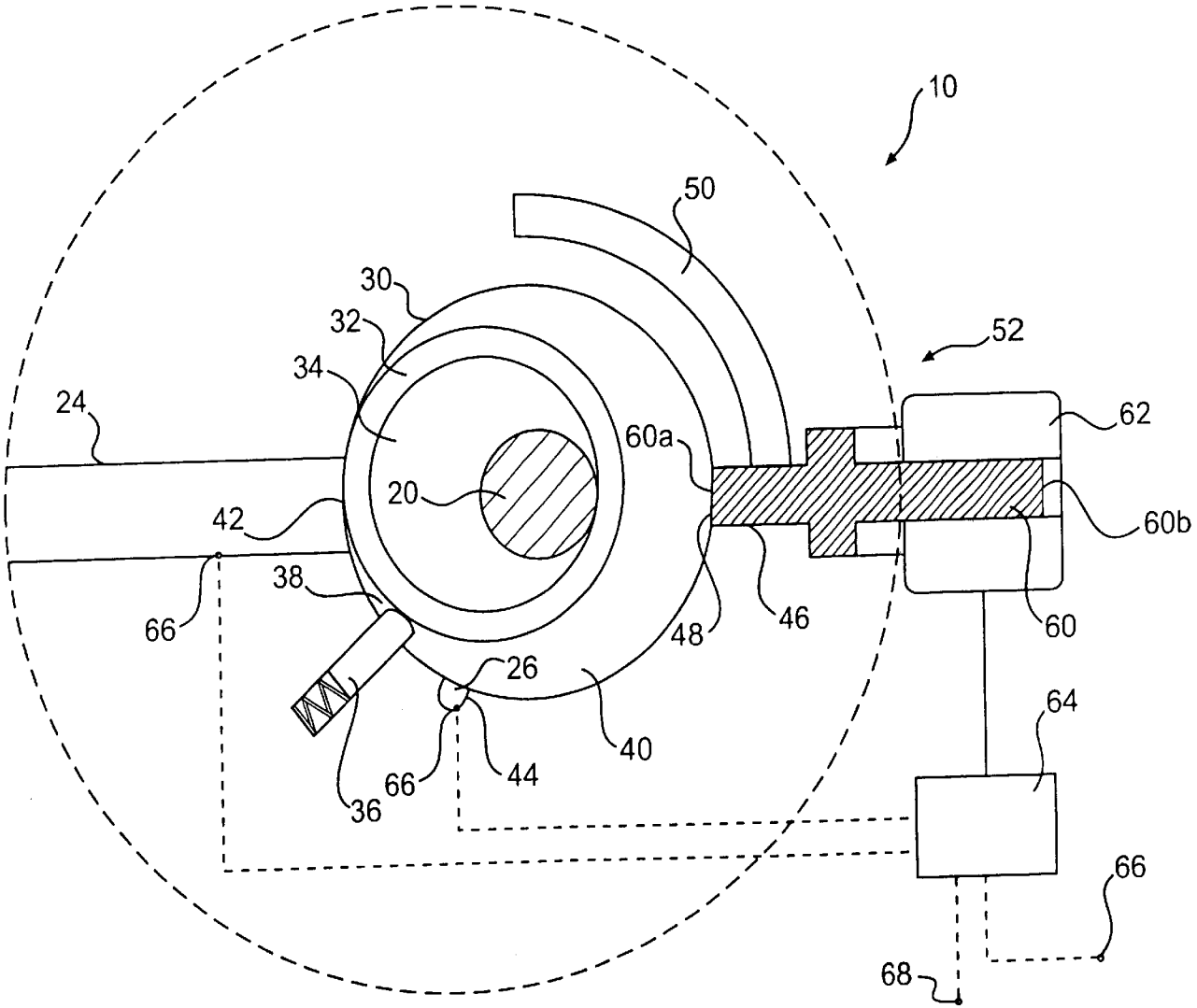
FIG. 5 is a partially schematic partial sectional view on line 2—2 of FIG. 1, showing the embodiment of the capacity modulation system of the present invention shown in FIG. 4 in a full capacity mode.

In another embodiment, shown in FIGS. 4 and 5, the valve 52 comprises a valve element controlled to open or close in response to a control signal. For example, in FIGS. 4 and 5 the valve includes a sliding element 60 engaged by a solenoid 62. The sliding element 60 has a forward surface 60*a* and a rear surface 60*b*. The solenoid 62 is actuated to move the sliding element 60 in response to a control signal received from a control device 64. The control device 64 generates the control signal based on input received from one or more sensors 66 located internal or external to the compressor 12. The valve actuator has been described as a solenoid, but other equivalent actuators, including pneumatic and hydraulic actuators, are considered within the scope of the invention.

As shown in FIGS. 4 and 5, the internal sensors 66 can be located in the suction channel 24 and/or the discharge channel 26. For example, the sensors 66 can be pressure sensors, and the control device 64 can cause the solenoid to move the valve 52 to the closed position when the discharge pressure or the pressure differential reaches a predetermined value. Other sensor locations internal to the compressor 12 are considered within the scope of the invention. For example, temperature sensors could be used.

Sensors external to the compressor 12 can also be used and can be located in an any suitable location to measure a desired parameter. One external sensor 66 is shown schematically in FIGS. 4 and 5.

Sensors can be used to measure all types of parameters internal and external to the compressor 12. Examples of parameters internal to the compressor 12 are flow rate, fluid temperature, and fluid pressure. External parameters include air temperature, equipment temperature, humidity, and noise. The valve position, and thus capacity, can be varied as a function of these parameters. Typical control devices used to generate control signals are thermostats, humidistats, and other equivalent devices. Other internal and external parameters and control devices are within the scope of the invention. The control device 64 receives input from the sensors 66 and, guided by internal software or control specifications, actuates the valve 52 to operate the compressor 12 in the full capacity mode or reduced capacity mode to provide optimum capacity and efficiency at given sensed conditions.

FIG. 4 shows the compressor 12 of this embodiment in the reduced capacity mode. As described above, when the compressor 12 is operated in this mode, a portion of the fluid is compressed into the reexpansion chamber 50 during each compression cycle. When the roller 32 passes the reexpansion port 48, the fluid in the reexpansion chamber 50 expands back to the low pressure section 38 of the compression chamber 30. The remaining fluid in the high pressure section 40 is further compressed until it is discharged from the compression chamber 30 through the discharge port 44.

The compressor 12 operates in the reduced capacity mode until an internal or external parameter is reached, according to the input from one or more sensors 66. In response to the sensor input, the control device 64 generates a control signal to actuate the solenoid 62. When the solenoid 62 is actuated, it moves the sliding element 60 from the first position to the second position, thereby putting the compressor 12 into the full capacity mode. The valve 52 of this embodiment, therefore, operates in response to a parameter internal or external to the compressor 12.

FIG. 5 shows the compressor 12 of this embodiment in the full capacity mode. As shown, the forward surface 60*a* of the sliding element 60 is substantially flush with the wall of the compression chamber 30. As the roller 32 proceeds around the compression chamber 30, all of the fluid in the low pressure section 38 is compressed until it is discharged through the discharge port 44. Thus, in the full capacity mode, each compression stroke of the roller 32 produces a larger volume of high pressure fluid.

The capacity modulation system 10 of this embodiment may also be utilized so that the compressor 12 begins operation in the full capacity mode and transitions to the reduced capacity mode in response to the measurement of an internal or external parameter.

In an alternative embodiment, the valve 52 can be manually controlled using a switch 68 connected to the control device 64, as shown in FIGS. 4 and 5. With the switch 68, a user can change the operational mode of the compressor 12 between the full capacity mode and the reduced capacity mode, as desired.

Although the valves 52 of the above-described embodiments have been described as comprising a sliding element 54, 60, a variety of other mechanisms can be applied according to the principles of the present invention. Examples of suitable valves include ball valves, gate valves, globe valves, butterfly valves, and check valves. These valves can be positioned along the reexpansion channel 46 between the compression chamber 30 and the reexpansion chamber 50. Further, the valves can be designed to open and permit fluid flow between the chambers when the compressor 12 is to be operated in the reduced capacity mode, and to close and prevent, or significantly limit, flow when the compressor 12 is to be operated in the full capacity mode. More generally, such valves or other flow control devices are arranged to increase or decrease the capacity of the compressor, as a function of one or more operating parameters. Preferably, the valves or flow control devices vary the capacity of the compressor, as a function of the compressor itself, so that no external controls are required.

The specific embodiments of FIGS. 1–5 discussed above provide a rotary or swing link compressor with a dual capacity. However, the principles of the invention can be applied to provide a compressor 12 having three or more differential capacities by providing more than one reexpansion chamber 50.

Figure 6:
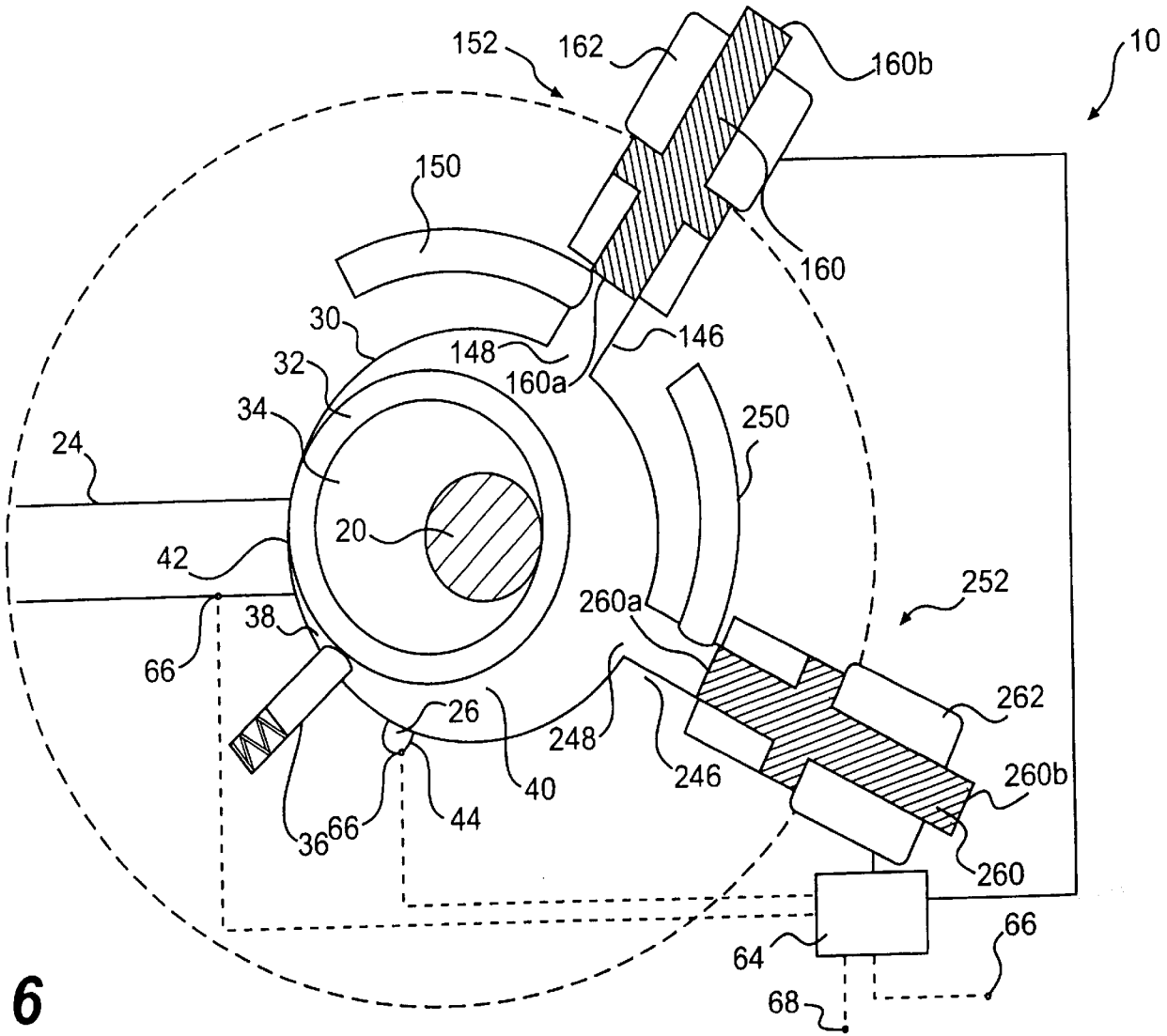
FIG. 6 is a partially schematic partial sectional view on line 2—2 of FIG. 1, showing yet another embodiment of the capacity modulation system of the present invention in a reduced capacity mode.

In a further embodiment of the capacity modulation system 10 of the present invention shown in FIG. 6, two separate reexpansion chambers 150, 250 and reexpansion channels 146, 246 are provided to selectively communicate with the compression chamber 30 under desired conditions. In this embodiment, the general elements and valve systems described above are used for each reexpansion chamber 150, 250.

In operation, the control device 64 of this embodiment opens both valves 152, 252 to allow flow between the compression chamber 30 and both reexpansion chambers 150, 250 to operate the compressor at a maximum level of capacity reduction. Two intermediate levels of capacity reduction are achieved by selectively opening the first valve 152 and closing the second valve 252, then closing the first valve 152 and opening the second valve 252. When both valves 152, 252 are closed, the compressor 12 operates at full capacity. The control device 64 can select the proper valve configuration to optimize the operation of the compressor 12 under a given set of conditions. Alternatively, as shown in FIG. 6, a switch 68 may be provided to allow manual control over the capacity of the compressor 12. Compressors utilizing more than two reexpansion chambers are within the scope of the invention.

In a further embodiment, a portion of a single reexpansion chamber can be designed so that the volume exposed to the compressed fluid can be varied by valves or other means.

Figure 8:
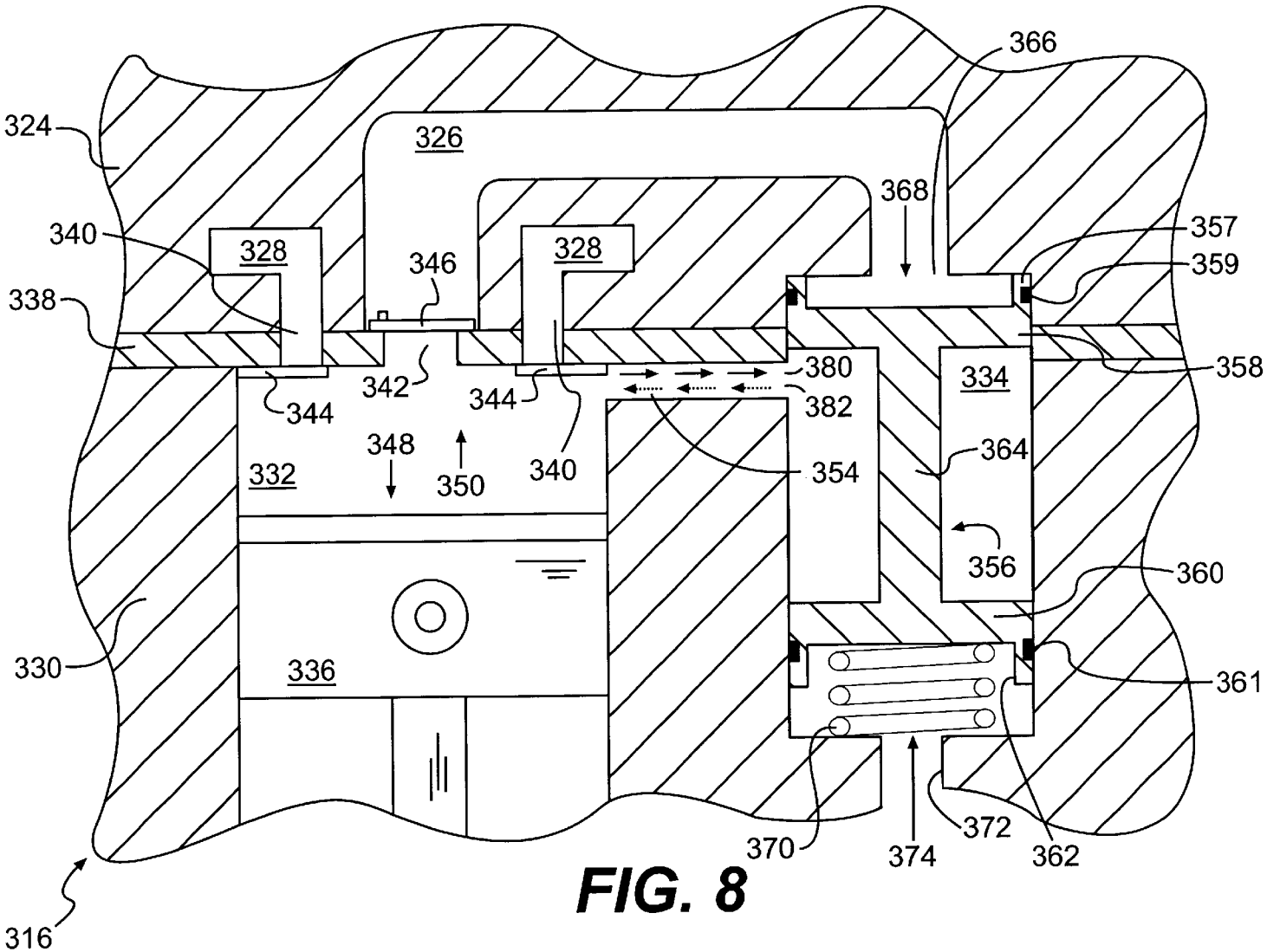
FIG. 8 is a partial section view of an embodiment of the present invention, incorporated in a reciprocating compressor for an air-conditioning or refrigeration system.
Figure 9:
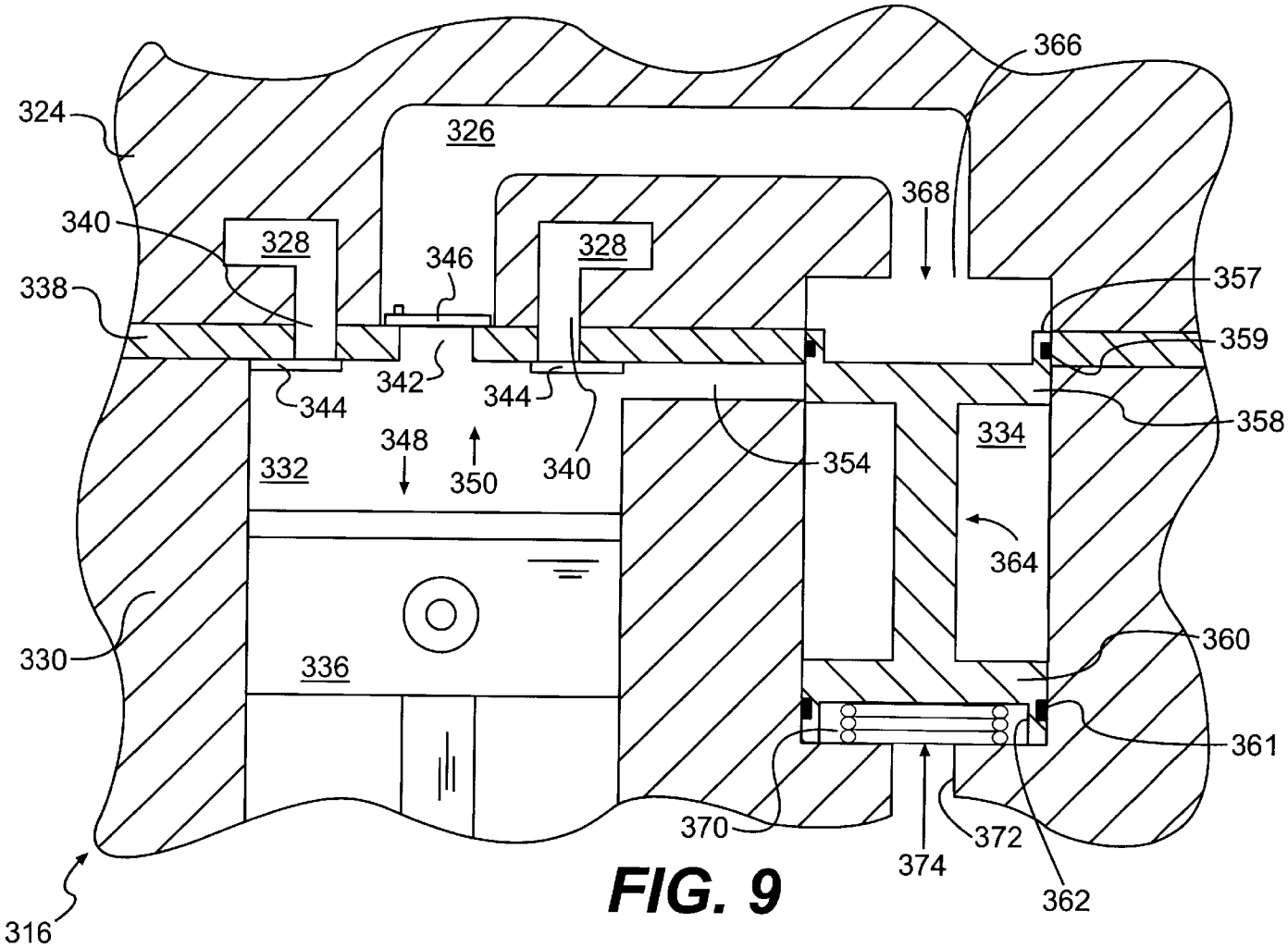
FIG. 9 is a partial section view of the embodiment of FIG. 8, showing the valve member in a position to prevent flow through the flow passage.

FIGS. 8 and 9 illustrate another embodiment of a compressor of the present invention for an air-conditioning or refrigeration system. In the illustrated embodiment, compressor 316 is a reciprocating compressor. The reciprocating compressor 316 includes a crankcase 330 and a manifold 324. The manifold 324 includes a suction channel 328 in fluid communication with the suction line 315 (FIG. 7) to receive the fluid from the evaporator 312 at a suction pressure. The manifold 324 also includes a discharge channel 326 in fluid communication with the discharge line 317 (FIG. 7) to discharge the fluid at a discharge pressure to the condenser 314. A compression chamber 332 formed in the crankcase 330 is in fluid communication with the suction channel 328 and receives the fluid therefrom at the suction pressure. The compression chamber 332 is also in fluid communication with the discharge channel 326 and the fluid is discharged to the discharge channel 326 at the discharge pressure.

The reciprocating compressor 316 includes a reciprocating piston 336 positioned and movable within the compression chamber 332 to compress fluid (e.g., refrigerant) entering the compression chamber 332 through the suction channel 328 and to discharge the fluid to the discharge channel 326. A valve plate 338 mounted on the crankcase 330 has an inlet 340 and an outlet 342. An inlet valve 344 opens and closes the inlet 340 to control the flow of the fluid into the compression chamber 332 from the suction channel 328. Similarly, an outlet valve 346 opens and closes the outlet 342 to control the flow of the fluid out of the compression chamber 332 to the discharge channel 326. A variety of different known valves and valve systems, such as those now commercially used, can be applied to control the flow into and out of the compression chamber 332.

When the reciprocating piston 336 moves in a suction stroke 348, the inlet valve 344 opens and the fluid at the suction pressure enters the compression chamber 332 from the suction channel 328 through the inlet 340. The outlet valve 346 remains closed while the reciprocating piston 336 moves in the suction stroke 348. On the other hand, the reciprocating piston 336 moving in a compression stroke 350 compresses the fluid within the compression chamber 332. When the pressure differential across the outlet valve 346 (i.e., the difference between the pressure within the compression chamber 332 and the discharge pressure in the discharge channel 326) reaches a predetermined value, the outlet valve 346 opens and discharges the fluid to the discharge channel 326 at the discharge pressure. In other words, when the reciprocating piston 336 increases the fluid pressure within the compression chamber 332 over the discharge pressure in the discharge channel 326 by the predetermined value, the outlet valve 346 opens to discharge the fluid to the discharge channel 326, which is in fluid communication with the condenser 314 (FIG. 7) through the discharge line 317. The inlet valve 344 remains closed while the reciprocating piston 336 moves in the compression stroke 350.

The reciprocating compressor 316 further includes a reexpansion chamber 334. This reexpansion chamber can be in a variety of forms and can be sized to achieve the desired variation between a first compressor capacity and a second compressor capacity. Preferably, the reexpansion chamber is machined into the block or the crankcase of the compressor and sized such that the reduce compressor capacity is 70 to 90% of the full capacity. The reexpansion chamber 334 is in fluid communication with the compression chamber 332 through a flow passage 354. In the embodiment shown in FIG. 8, the flow passage 354 is defined by the valve plate 338 and a recess formed in the crankcase 330. A flow passage formed in the crankcase 330, rather than defined by valve plate 338 and a recess formed in the crankcase 330, is also within the scope of the present invention.

A valve member 356 positioned within the reexpansion chamber 334 controls the flow of the fluid between the compression chamber 332 and the reexpansion chamber 334 by permitting and preventing flow through the flow passage 354. As explained below, the valve member 356 operates similarly to the sliding element 54 of the rotary compressor shown in FIGS. 2 and 3. The valve member 356 is movable between a first position permitting flow through the flow passage 354 (FIG. 8) and a second position preventing flow through the flow passage 354 (FIG. 9).

In the embodiment shown in FIGS. 8 and 9, the valve member 356 includes a head portion 358, a tail portion 360, and a stem portion 364 connecting the head and tail portions 358 and 360. The side surfaces of the head and tail portions 358 and 360 respectively have sealing members 359 and 361, such as o-rings, provided therein for a sealing contact with the inner surface of the reexpansion chamber 334. In this embodiment, the head and tail portions 358 and 360 and the reexpansion chamber 334 are circular in shape and are sized to have a close fit between the opposed surfaces.

As designated by the reference number 368 in FIGS. 8 and 9, the head portion 358 of the valve member 356 is exposed continuously to the discharge pressure of the fluid through an opening 366 in fluid communication with the discharge channel 326. Accordingly, the fluid at the discharge pressure continuously acts on the head portion 358 and continuously exerts a force on valve member 356 in a direction tending to seat the bottom of the tail portion 360 against the bottom of the reexpansion chamber 334 and prevent flow through the flow passage 354, as shown in FIG. 9.

An annular projection 357 formed on the head portion 358 abuts the top surface of the reexpansion chamber 334 when the valve member 356 is the first position permitting flow through the flow passage 354, as shown in FIG. 8. The surface area of the annular projection 357 may be adjusted to vary the area of the head portion 358 exposed to the discharge pressure. For example, if a substantially constant area exposed to the discharge pressure is desired regardless of the position of the valve member 356, the surface area of the annular projection 357 may be minimized. Alternatively, instead of the annular projection 357, projections spaced apart from each other may be provided if a substantially constant area exposed to the discharge pressure is desired. On the other hand, if the surface area of the annular projection 357 is substantial, the area exposed to the discharge pressure may be significantly increased when the valve member 356 begins to move from the first position shown in FIG. 8 to the second position shown in FIG. 9. Instead of the annular projections 357 formed on the head portion 358 of the valve member 356, a recess may be formed around the opening 366 for the same purpose.

The tail portion 360 of the valve member 356 has a recessed portion 362. A biasing member 370 is positioned in the recessed portion 362 and exerts a biasing force in a direction to abut the annular projection 357 against the top surface of the reexpansion chamber 334 and permit flow through the flow passage 354, as shown in FIG. 8. The biasing force, therefore, opposes the force exerted on the valve member 356 by the discharge pressure. In addition, the recessed portion 362 is exposed to the suction pressure of the fluid through an opening 372, which is in fluid communication with the suction channel 328. Thus, as designated by the reference number 374 in FIGS. 8 and 9, the suction pressure acts on the recessed portion 362 to exert a force on the valve member 356 in the same direction of the biasing force. Accordingly, the biasing force of biasing member 370 and the force exerted by the suction pressure combine to oppose the force exerted by the discharge pressure.

When the force exerted by the discharge pressure is less than the combined force (i.e., the biasing force of the biasing member 370 plus the force exerted by the suction pressure), the valve member 356 is in the first position permitting flow through the flow passage 354, as illustrated in FIG. 8. When the valve member 356 is in the first position permitting flow through the flow passage 354, the reciprocating compressor 316 operates in a reduced capacity mode because some of the fluid entering and exiting the compression chamber 332 through the inlet 340 and outlet 342 flows into and out of the reexpansion chamber 334.

As the reciprocating piston 336 moves in the compression stroke 350 with the valve member 356 in the first position illustrated in FIG. 8, some of the fluid within the compression chamber 332 flows through the flow passage 354 into the reexpansion chamber 334 as designated by the solid arrows 380. Subsequently, as the reciprocating piston 336 moves in the suction stoke 348 with the valve member 356 in the first position illustrated in FIG. 8, the fluid in the reexpansion chamber 334 expands and flows back into the compression chamber 332 as designated by the dashed arrows 382. Accordingly, the reciprocating compressor 316 operates in a reduced capacity mode because the amount of the fluid entering and exiting the compression chamber 332 through the inlet 340 and outlet 342 is less when the valve member 356 is in the first position permitting flow through the flow passage 354 than when the valve member 356 is in the second position preventing flow through the flow passage 354.

When the discharge pressure reaches a predetermined level, however, the force exerted by the discharge pressure overcomes the combined force (i.e., the biasing force of the biasing member 370 plus the force exerted by the suction pressure) and moves the valve member 356 to the second position preventing flow through the flow passage 354, as illustrated in FIG. 9. When the valve member 356 is in the second position preventing flow through the flow passage 354, the reciprocating compressor 316 operates in a full capacity mode because the fluid entering and exiting the compression chamber 332 through the inlet 340 and outlet 342 does not flow into and out of the reexpansion chamber 334.

The degree of capacity modulation is determined by a variety of factors, including the volume of the reexpansion chamber 334 available to the fluid and the location of the flow passage 354. Generally, increasing the volume of the reexpansion chamber 334 available to the fluid results in a greater capacity modulation. Also, locating the flow passage 354 closer to the top of the compression chamber 332 results in a greater capacity modulation. A desired capacity modulation can therefore be controlled by adjusting the volume of the reexpansion chamber 334 available to the fluid and the location of the flow passage 354. Preferably, the volume of the reexpansion chamber 334 available to the fluid and the location of the flow passage 354 are adjusted such that the reduced capacity is 70 to 90% of the full capacity.

Similarly, the level of the discharge pressure at which the valve member 356 prevents flow through the flow passage 354 is determined by a variety of factors, including the biasing force exerted by the biasing member 370 and the suction pressure. A desired level of the discharge pressure at which valve member 356 prevents flow through the flow passage 354 can therefore be controlled by adjusting the combined force exerted by the biasing member 370 and the suction pressure. The suction pressure, however, is a system parameter, which cannot be readily adjusted. The biasing force, on the other hand, can be readily adjusted. Accordingly, a desired level of the discharge pressure at which the valve member 356 prevents flow through the flow passage 354 can be most readily controlled by adjusting the biasing force. For example, a biasing member having a different spring constant can be selected to control the level of the discharge pressure at which the valve member 356 prevents flow through the flow passage 354. A variety of suitable springs and other elastic elements may be used for the biasing member. Examples of suitable springs include, among other springs, coil springs and torsion springs.

Figure 10:
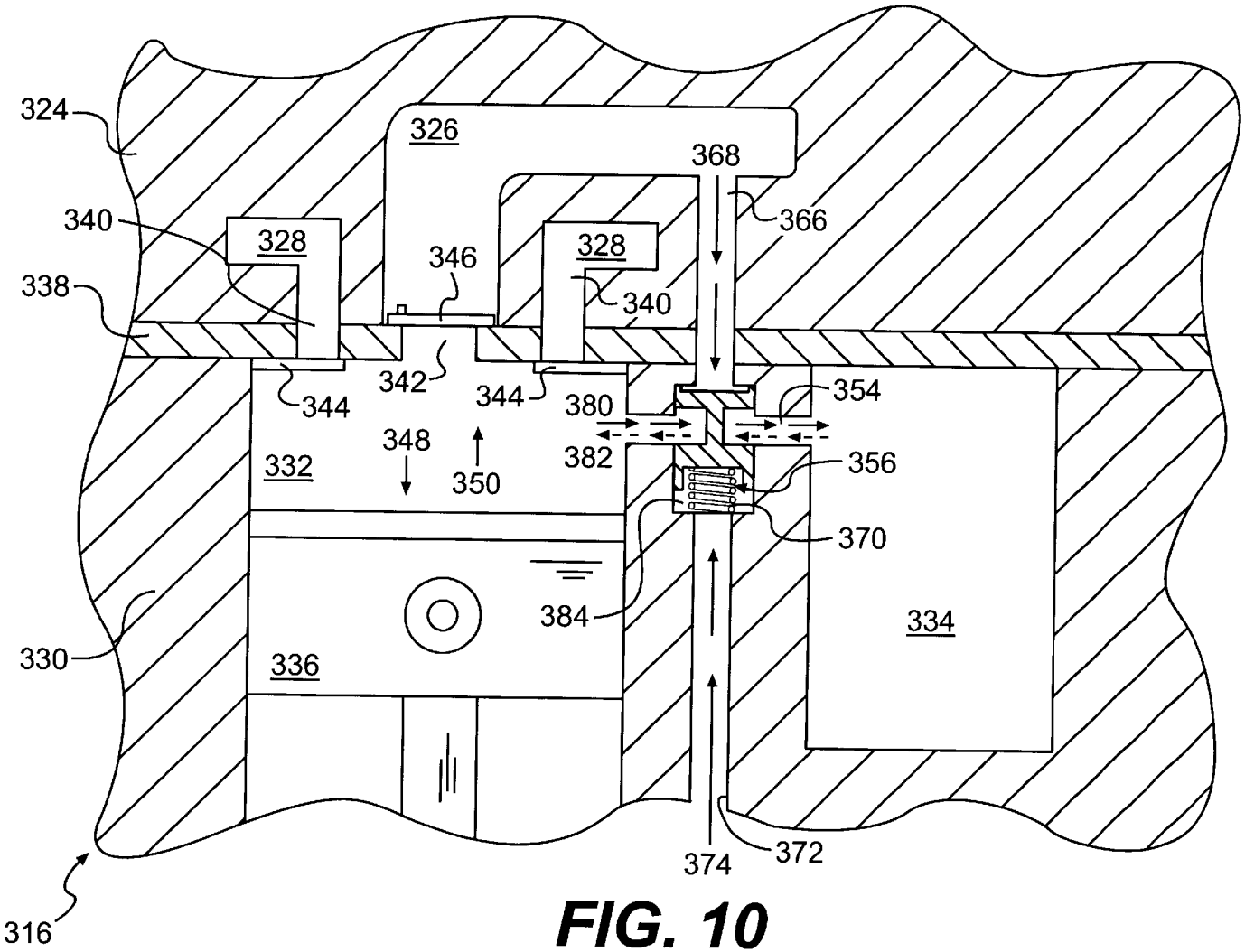
FIG. 10 is a partial section view of another embodiment of the present invention, incorporated in a reciprocating compressor for an air-conditioning or refrigeration system.
Figure 11:
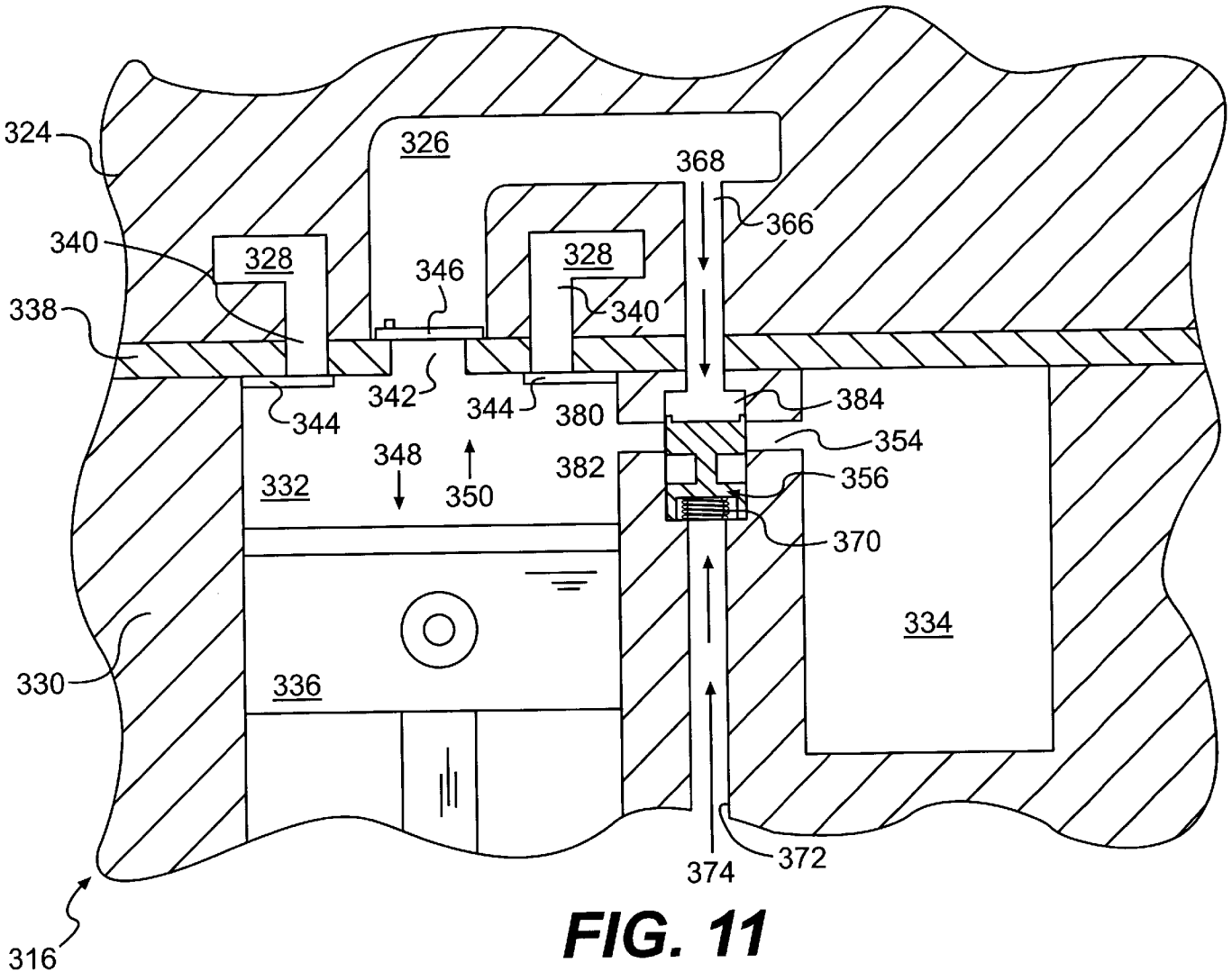
FIG. 11 is a partial section view of the embodiment of FIG. 10, showing the valve member in a position to prevent flow through the flow passage.

The embodiment illustrated in FIGS. 8 and 9 may also be modified so that the valve member is not positioned within the reexpansion chamber. For example, as illustrated in FIGS. 10 and 11, the valve member 356 may be positioned within a valve chamber 384 formed in the crankcase 330 between the compression chamber 332 and the reexpansion chamber 334. Instead of moving within the reexpansion chamber 334, the valve member 356 moves within the valve chamber 384 between a first position permitting flow through the flow passage 354 (FIG. 10) and a second position preventing flow through the flow passage 354 (FIG. 11). As shown, the structure and operation of the valve member 356 shown in FIGS. 10 and 11 are essentially the same as those of the embodiment shown in FIGS. 8 and 9.

In these embodiments, as in the embodiment applied to the rotary compressor, two or more reexpansion chambers and associated flow passages and valves can be incorporated into the compressor to allow more than two different capacities. In any embodiment, the valve arrangement preferably provides for automatic modulation of the compressor capacity based solely on the compressor and the reexpansion chambers, valves, and flow passages incorporated into the compressor. Thus, the compressor will automatically regulate itself, as the discharge pressure reaches a predetermined value relative to the suction pressure.

As explained above, the degree of capacity modulation and the level of the discharge pressure at which the valve member 356 prevents flow through the flow passage 354 are two parameters that can be controlled to optimize a given heat exchanging system. The optimum combination of the degree of capacity modulation and the level of the discharge pressure at which the valve member 356 prevents flow through the flow passage 354 may be determined through analytical calculations, empirical testing, or a combination of both. The optimum combination, of course, changes for different heat exchanging systems having different design characteristics and operating conditions.

For an air-conditioning or refrigeration system, the system efficiency can be improved by operating the compressor in a reduced capacity mode. The system efficiency of an air-conditioning or refrigeration system increases as the temperature and pressure in a condenser decrease. The temperature and pressure in the condenser, on the other hand, decrease as the capacity of the system decreases. Accordingly, the system efficiency of an air-conditioning or refrigeration system improves if the capacity of the system is reduced.

An air-conditioning or refrigeration system, however, needs to provide a certain cooling capacity at a certain condition even if the system efficiency suffers as a consequence. For example, to maintain a space at a comfortable temperature, an air-conditioning system needs to operate in a full capacity mode during a hot summer day even if doing so decreases the system efficiency.

For many air-conditioning or refrigeration systems, a condenser is customarily located outdoor to reject heat to outside air. The Seasonal Energy Efficiency Ratio (SEER) is a parameter indicating how efficiently such systems operate. The SEER value for such systems is determined by a weighted average of the system efficiencies at different capacities. Because the condenser is subjected to varying outside air temperatures, the weights given to the system efficiencies at different capacities are calculated based on the most common building types and their operating hours using average weather data in the United States.

To determine a SEER value using these calculated weights, the Air-Conditioning & Refrigeration Institute (ARI) requires that the system efficiencies at different capacities be measured at specified air temperatures. For example, the ARI requires that the system efficiency at 100% capacity can be measured at an ambient (outside) air temperature of 95° F. This system efficiency, however, contributes minimally to the SEER value because the number of hours that a condenser is subjected to an outside air temperature of 95° F. is limited. Instead, the system efficiency at a reduced outside air temperature contributes more to the SEER value.

Accordingly, the degree of capacity modulation and the level of the discharge pressure at which the valve member 356 prevents flow through the flow passage 354 can be optimized to increase the SEER value for an air-conditioning or refrigeration system. For example, the spring constant of the biasing member 370 can be selected such that the valve member 356 prevents flow through the flow passage 354 when the outside air temperature is greater than a predetermined value. Also, for a compressor having a plurality of compression chambers and corresponding reexpansion chambers, each reexpansion chamber may utilize a biasing member with a different spring constant in order to provide one or more intermediate capacity modulation depending on the outside air temperature.

As is well known, the pressure and temperature in the condenser 314 increase as the outside air temperature increases and the compressor discharge pressure and temperature increase as the pressure and temperature in the condenser 314 increase. Accordingly, the spring constant of the biasing member 370 can be selected such that when the outside air temperature is greater than a predetermined value, the compressor discharge pressure increases to the level at which the valve member 356 prevents flow through the flow passage 354. The predetermined value of the outside air temperature should be selected to maximize the SEER value for a given air-conditioning or refrigeration system. By way of example only, an outside air temperature in the range of 74 to 94° F. can be used as the predetermined value above which the valve member 356 prevents flow through the flow passage 354. In other words, a given air-conditioning or refrigeration system operates in a reduced capacity mode unless an outside air temperature is greater than a predetermined value in the range of 75 to 94° F.

Figure 12:
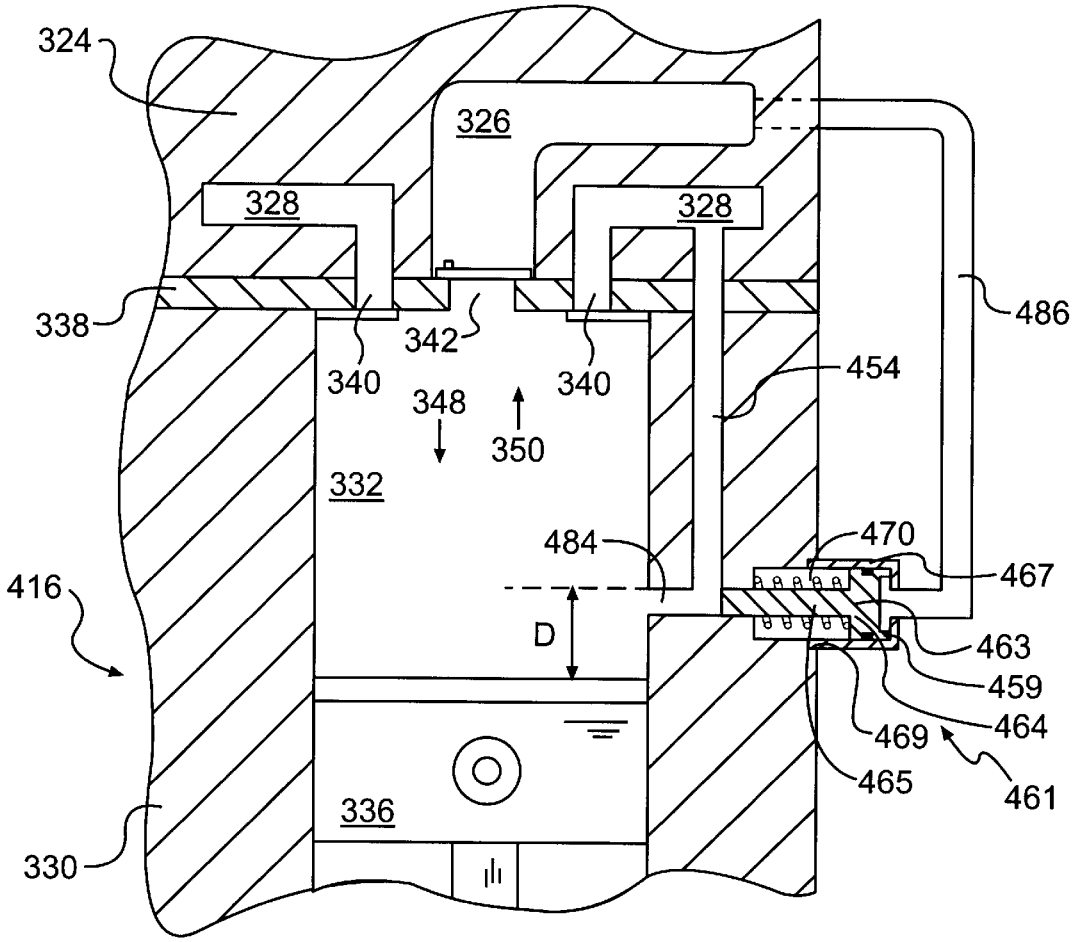
FIG. 12 is a partial section view of another embodiment of the present invention, incorporated in a reciprocating compressor for an air-conditioning or refrigeration system.
Figure 13:
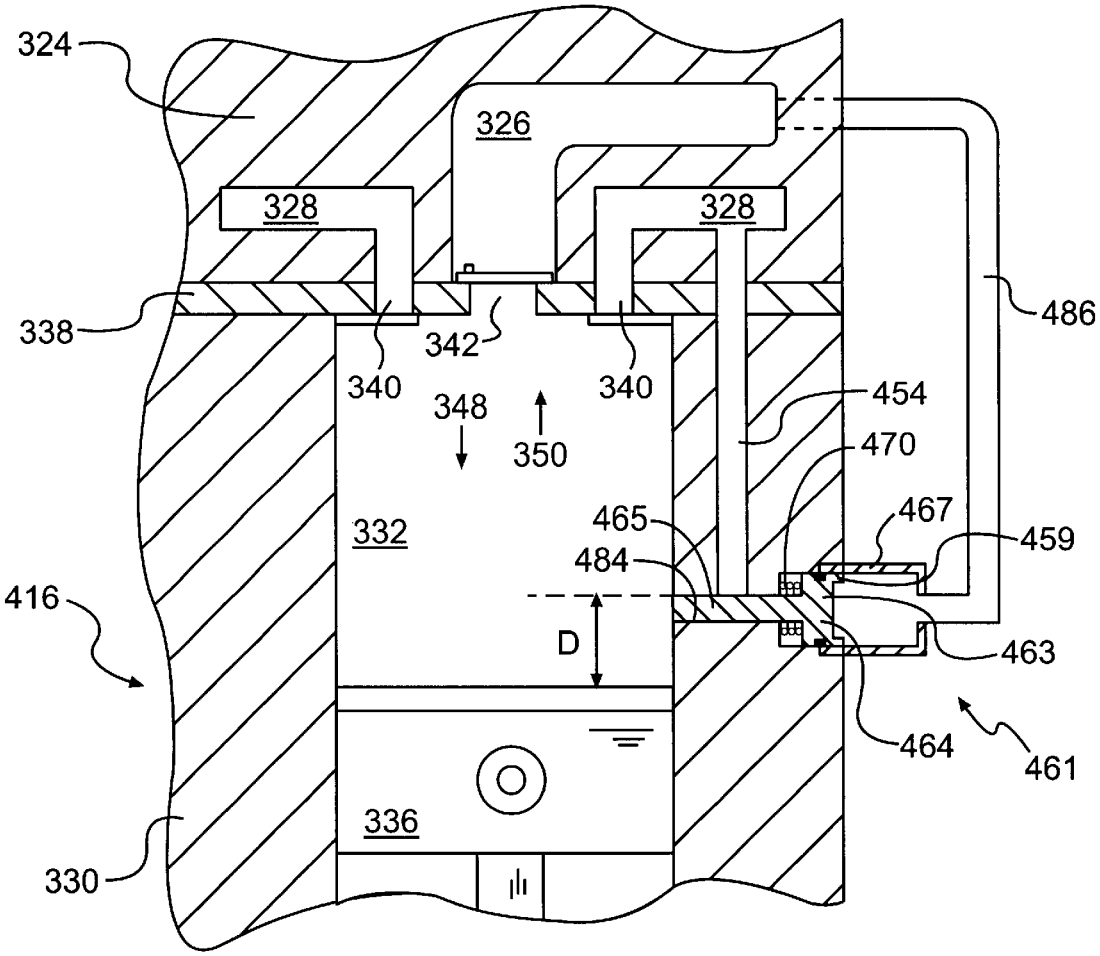
FIG. 13 is a partial section view of the embodiment of FIG. 12, showing the valve member in a position to prevent flow through the flow passage.

FIGS. 12 and 13 illustrate another embodiment of a reciprocating compressor of the present invention. In the illustrated embodiment, a reciprocating compressor 416 includes a flow passage 454 in fluid communication with the suction channel 328. The flow passage 454 is also in fluid communication with the compression chamber 332 through an opening 484 formed on a side surface of the compression chamber 332. The opening 484 is formed between a bottom dead center position and a top dead center position of the reciprocating piston 336. The top of the opening 484 is formed a predetermined distance D away from the top surface of the reciprocating piston 336 in its bottom dead center position.

The reciprocating compressor 416 further includes a valve mechanism 461. The valve mechanism 461 includes a cap 467 and a valve member 464. The cap is fittingly engaged (e.g., threaded engagement) with a hole 469 formed in the crankcase 330. The valve member 464 positioned within the cap 467 and the hole 469 controls the flow of the fluid between the compression chamber 332 and the suction channel 328 by permitting and preventing flow through the flow passage 454. The valve member 464 is movable between a first position permitting flow through the flow passage 454 (FIG. 12) and a second position preventing flow through the flow passage 454 (FIG. 13).

The valve member 464 includes a head portion 463 and a stem portion 465. As illustrated in FIGS. 12 and 13, the head portion 463 of the valve member 464 is exposed continuously to the discharge pressure of the fluid through a feed line 486, which is in fluid communication with the discharge channel 326. Accordingly, the fluid at the discharge pressure continuously acts on the head portion 463 and continuously exerts a force in a direction such that the valve member 464 prevents flow through the flow passage 454.

The valve mechanism 461 further includes a biasing member 470, such as a coil spring, exerting a biasing force in a direction such that the valve member 464 permits flow through the flow passage 454. In addition, the front surface of the stem portion 465 is continuously exposed to the pressure within the compression chamber 332. Accordingly, at least the suction pressure continuously acts on the front surface of the stem portion 465 to exert a force on the valve member 464 in the same direction of the biasing force. Accordingly, the biasing force of the biasing member 470 and the force exerted by the suction pressure combine to oppose the force exerted by the discharge pressure.

As illustrated in FIG. 12, when the force exerted by the discharge pressure is less than the combined force (i.e., the biasing force of the biasing member 470 plus the force exerted by the suction pressure), the valve member 464 is in the first position and permits flow through the opening 484 and the flow passage 454 to the suction channel 328. When the valve member 464 is in the first position opening the flow passage 454, the reciprocating compressor 416 operates in a reduced capacity mode. In this mode, the fluid in the compression chamber 332 flows back through the opening 484, into flow passage 454, and even into the suction channel 328 in the manifold 324. Similar to the reexpansion chamber described above, these elements are in effect combined to provide a reexpansion area in fluid communication with the compression chamber. In effect, the fluid in the compression chamber is not compressed beyond the suction pressure, until the reciprocating piston travels beyond the opening 484.

As the reciprocating piston 336 moves in the compression stroke 350 from its bottom dead center position toward its top dead center position, the fluid within the compression chamber 332 is discharged to the suction channel 328 through the opening 484 and flow passage 454. This discharge to the suction channel 328 continues until the top surface of the reciprocating piston 336 reaches the top of the opening 484 and closes the opening 484. In other words, until the reciprocating piston 336 moves the predetermined distance D from its bottom dead center position, no or little compression results. After the top surface of the reciprocating piston the top of the opening 484 and closes the opening 484, significant compression begins. Accordingly, the reciprocating compressor 416 effectively reduces the stroke length of the reciprocating piston 336 and therefore operates in a reduced capacity mode.

As illustrated in FIG. 13, however, when the discharge pressure reaches a predetermined level, the force exerted by the discharge pressure overcomes the combined force (i.e., the biasing force of the biasing member 470 plus the force exerted by the suction pressure) and moves the valve member 464 to the second position and the stem portion 465 prevents flow through the flow passage 454. When the valve member 464 is in the second position preventing flow through the flow passage 454, the reciprocating compressor 416 operates in a full capacity mode because no fluid exits the compression chamber 332 through the flow passage 454. In other words, the full stroke length of the reciprocating piston 336 is utilized to compress the fluid entering and exiting the compression chamber 332 through the inlet 340 and outlet 342.

When the valve member 464 is in the second position preventing flow through the flow passage 454, the front surface of the stem portion 465 is exposed to at least the suction pressure. In other words, the pressure acting on the front surface of the stem portion 465 varies from the suction pressure and an intermediate pressure achieved when the reciprocating piston 336 reaches the opening 484 from its bottom dead center position. To ensure that the valve member 464 does not experience a transitional phase where the valve member 464 flutters due to this increase in pressure within the compression chamber 332, the surface area of an annular projection 459 formed on the head portion 463 may be adjusted. As explained above, by increasing the surface area of the annular projection 459, the area exposed to the discharge pressure may be significantly increased when the valve member 464 begins to move from the first position (FIG. 12) to the second position (FIG. 13). Accordingly, the surface area of the annular projection 459 may be adjusted to offset the increase in pressure within the compression chamber 332.

Thus, by adjusting the location of the opening 484 relative to the bottom dead center position of the reciprocating piston 336, the reciprocating compressor 416 achieves a desired capacity modulation. Also, by adjusting the biasing force exerted by the biasing member 470, the reciprocating compressor 416 controls the discharge pressure at which valve member 464 prevents flow through the flow passage 454. Accordingly, as explained in relation to the embodiments illustrated in FIGS. 8–11, the system efficiency of an air-conditioning or refrigeration system can be improved by optimizing the combination of the degree of capacity modulation and the pressure at which the valve member 464 prevents flow through the flow passage 454. Preferably, the location of the opening 484 is adjusted such that the reduced capacity is 70 to 90% of the full capacity. Also, for example, an outside air temperature in the range of 75 to 94° F. may be utilized as the predetermined value above which the valve member 464 prevents flow through the flow passage 454.

Figure 14:
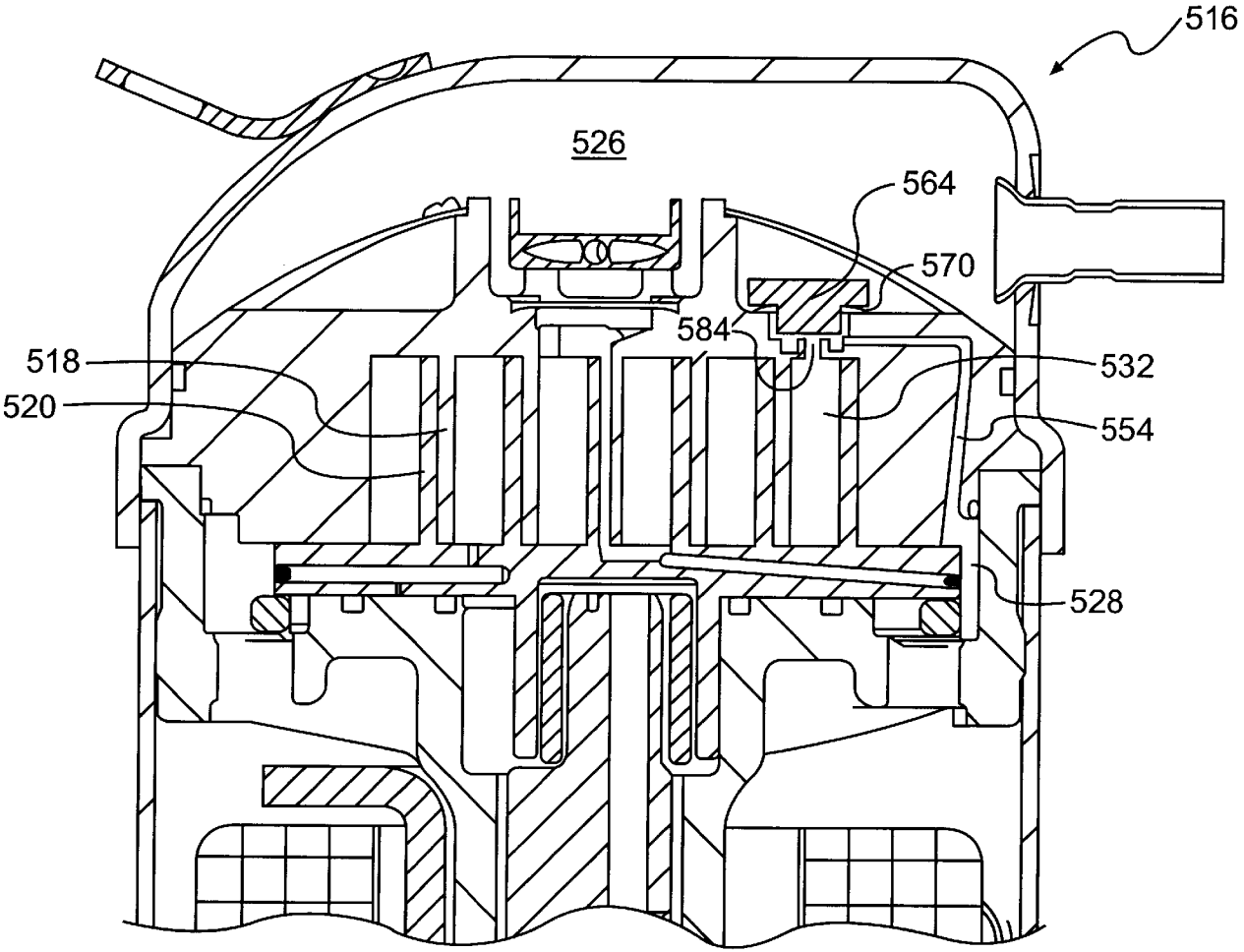
FIG. 14 is a partial section view of an embodiment of a scroll compressor for an air-conditioning or refrigeration system. As shown, a valve member is movable to permit and prevent flow through a flow passage in fluid communication with a compression chamber and a suction channel.

FIG. 14 illustrates another embodiment of a compressor of the present invention. In the illustrated embodiment, the compressor is a scroll compressor 516. The scroll compressor 516 includes a fixed scroll member 518 and a scroll member 520 movable in orbiting motion relative to the fixed scroll member 518. As is known in the art, the fixed and movable scroll members 518 and 520 are involute wraps intermeshed with each other and define one or more moving compression chambers. The moving compression chambers progressively decrease in size as the movable scroll member 520 orbits. The moving compression chambers travel from an outer inlet in fluid communication with a suction channel 528 to a center outlet in fluid communication with a discharge channel 526. The reference number 532 designates the outermost compression chamber.

The scroll compressor 516 of the present invention includes a flow passage 554 formed in the fixed scroll member 518. The flow passage 554 is in fluid communication with the suction channel 528. The flow passage 554 is also in fluid communication with the outermost compression chamber 532 through an opening 584 formed in the fixed scroll member 518. The scroll compressor 516 further includes a valve member 564. The valve member 564 controls the flow of the fluid between the outermost compression chamber 532 and the suction channel 528 by permitting and preventing flow through the flow passage 554. The valve member 564 is movable between a first position permitting flow through the flow passage 554 (FIG. 15) and a second position preventing flow through the flow passage 554 (FIG. 16).

Figure 15:
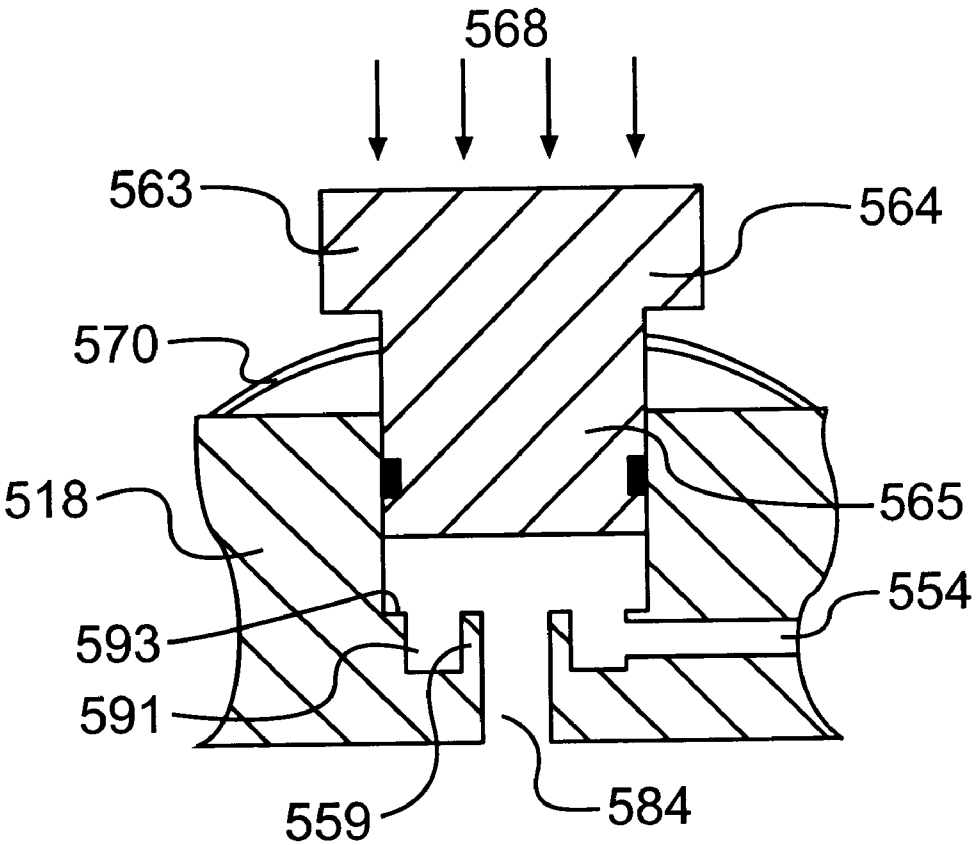
FIG. 15 an enlarged partial section view of the valve member and flow passage shown in FIG. 14, illustrating the valve member in a position permitting flow through the flow passage.
Figure 16:
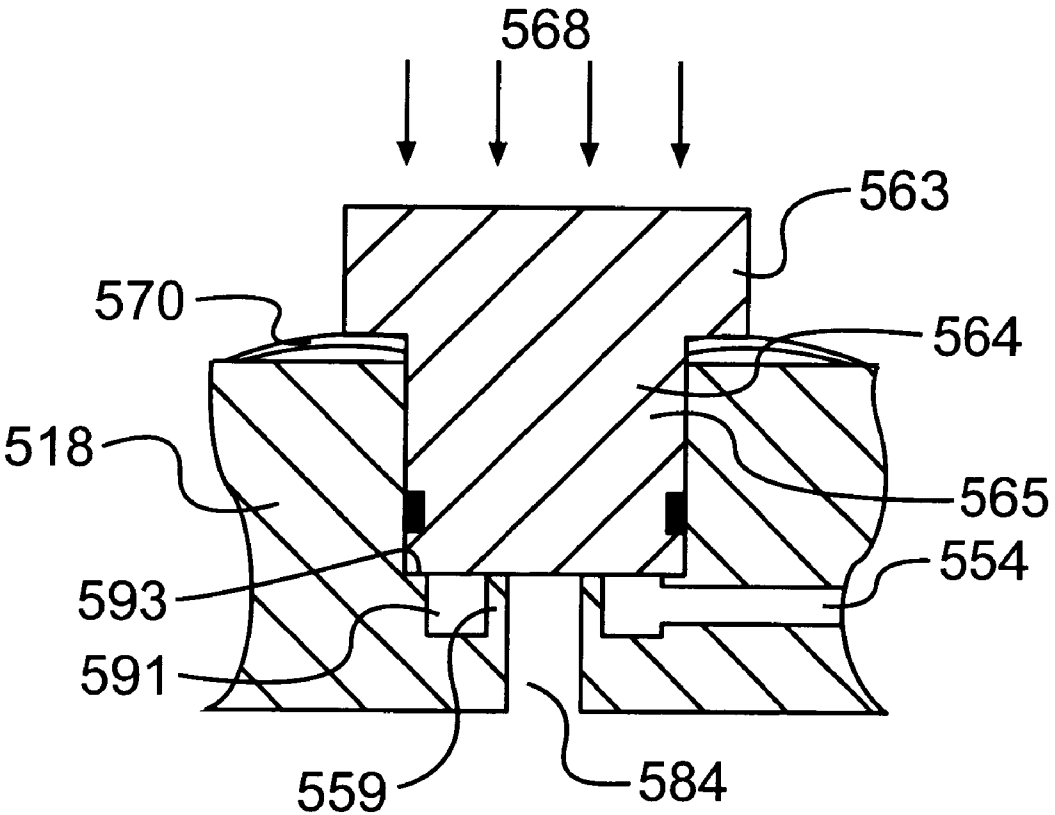
FIG. 16 is an enlarged partial section view of the valve member and flow passage shown in FIG. 14, illustrating the valve member in a position preventing flow through the flow passage.

As illustrated in FIGS. 15 and 16, the valve member 564 includes a head portion 563 and a stem portion 565. As designated by the reference number 568, the head portion 563 of the valve member 564 is exposed continuously to the discharge pressure of the fluid in the discharge channel 526.

Accordingly, the fluid at the discharge pressure continuously acts on the head portion 563 and continuously exerts a force on valve member 564 in a direction such that the valve member 564 prevents flow through the flow passage 554.

A biasing member 570, such as a coil spring, is positioned between the head portion 563 and the top surface of the fixed scroll member 518. The biasing member 570 exerts a biasing force in a direction such that the valve member 564 permits flow through the flow passage 554. In addition, the front surface of the stem portion 565 is exposed to the pressure within the outermost compression chamber 532, in effect the suction pressure. Accordingly, at least the suction pressure continuously acts on the front surface of the stem portion 565 to exert a force on the valve member 564 in the same direction of the biasing force. Accordingly, the biasing force of the biasing member 570 and the force exerted by the suction pressure combine to oppose the force exerted by the discharge pressure.

As illustrated in FIG. 15, when the force exerted by the discharge pressure is less than the combined force (i.e., the biasing force of the biasing member 570 plus the force exerted by the suction pressure), the valve member 564 is in the first position and permits flow through an annular recess 591 and the flow passage 554 to the suction channel 528. When the valve member 564 is in the first position permitting flow through the flow passage 554, the scroll compressor 416 operates in a reduced capacity mode.

As the movable scroll member 520 moves and decreases the volume within the outermost compression chamber 532, the fluid within the outermost compression chamber 532 is discharged therefrom through the annular recess 591 and the flow passage 554 to the suction channel 528. These therefore serve as a reexpansion area. After a predetermined amount of the fluid within the outermost compression chamber 532 is discharged, the movable scroll member 520 covers the opening 584 and stops further discharge. As the movable scroll member 520 further orbits, it again uncovers the opening 584 to discharge the fluid within the outermost compression chamber 532 to the suction channel 528.

As illustrated in FIG. 16, however, when the discharge pressure reaches a predetermined level, the force exerted by the discharge pressure overcomes the combined force (i.e., the biasing force of the biasing member 570 plus the force exerted by the suction pressure) and moves the valve member 564 to the second position and the stem portion 565 prevents flow through the flow passage 554. When the valve member 564 is in the second position preventing flow through the flow passage 554, the scroll compressor 516 operates in a full capacity mode because no fluid exits the outermost compression chamber 532 through the flow passage 554.

When the valve member 564 is in the second position preventing flow through the flow passage 554, the front surface of the stem portion 565 is exposed to at least the suction pressure. In other words, the pressure acting on the front surface of the stem portion 565 varies from the suction pressure and an intermediate pressure achieved when the movable scroll member 520 begins to cover the opening 584. To ensure that the valve member 564 does not experience a transitional phase where the valve member 564 flutters due to this increase in pressure within the outermost compression chamber 532, the surface area of an annular projection 559 as well as the surface area of an annular shoulder portion 593 may be adjusted. By increasing the surface area of the annular projection 559 and the surface area of the annular shoulder portion, the area exposed to the pressure within the outermost compression chamber 532 may be significantly reduced when the valve member 564 reaches the second position. Accordingly, the surface area of the annular projection 559 and the surface area of the annular shoulder portion 593 may be adjusted to offset the increase in pressure within the outermost compression chamber 532.

Therefore, by adjusting the location of the opening 584, the scroll compressor 516 achieves a desired capacity modulation. Also, by adjusting the biasing force exerted by the biasing member 570, the scroll compressor 516 controls the discharge pressure at which valve member 564 prevents flow through the flow passage 554. Accordingly, as explained in relation to the embodiments illustrated in FIGS. 8–11, the system efficiency of an air-conditioning or refrigeration system can be improved by optimizing the combination of the degree of capacity modulation and the pressure at which the valve member 564 prevents flow through the flow passage 554. Preferably, the location of the opening 584 is adjusted such that the reduced capacity is 70 to 90% of the full capacity. Also, for example, an outside air temperature of in the range of 75 to 94° F. may be utilized as the predetermined value above which the valve member 564 closes the flow passage 554.

Figure 17:
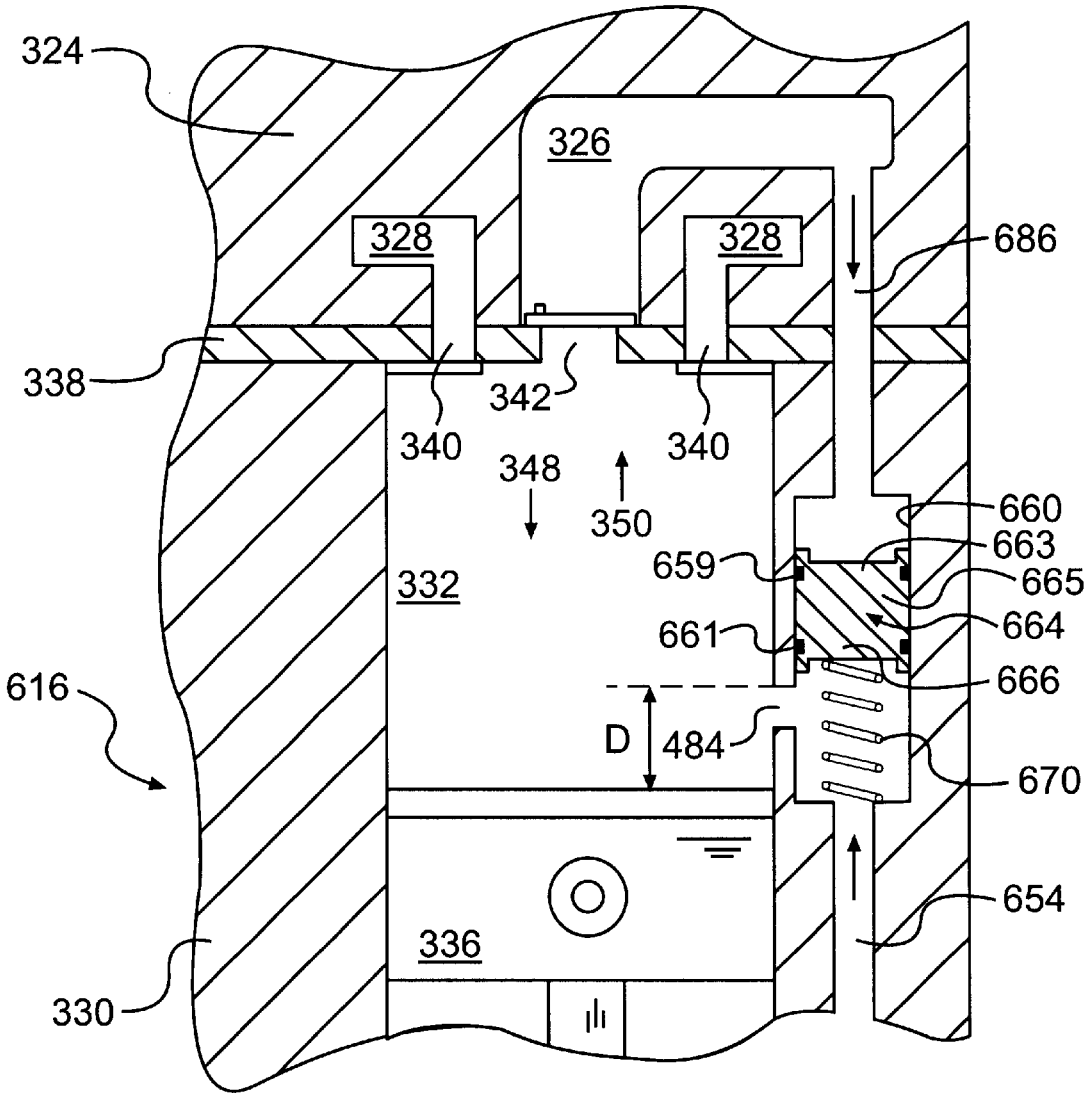
FIG. 17 is a partial section view of yet another embodiment of the present invention, incorporated in a reciprocating compressor for an air-conditioning or refrigeration system.
Figure 18:
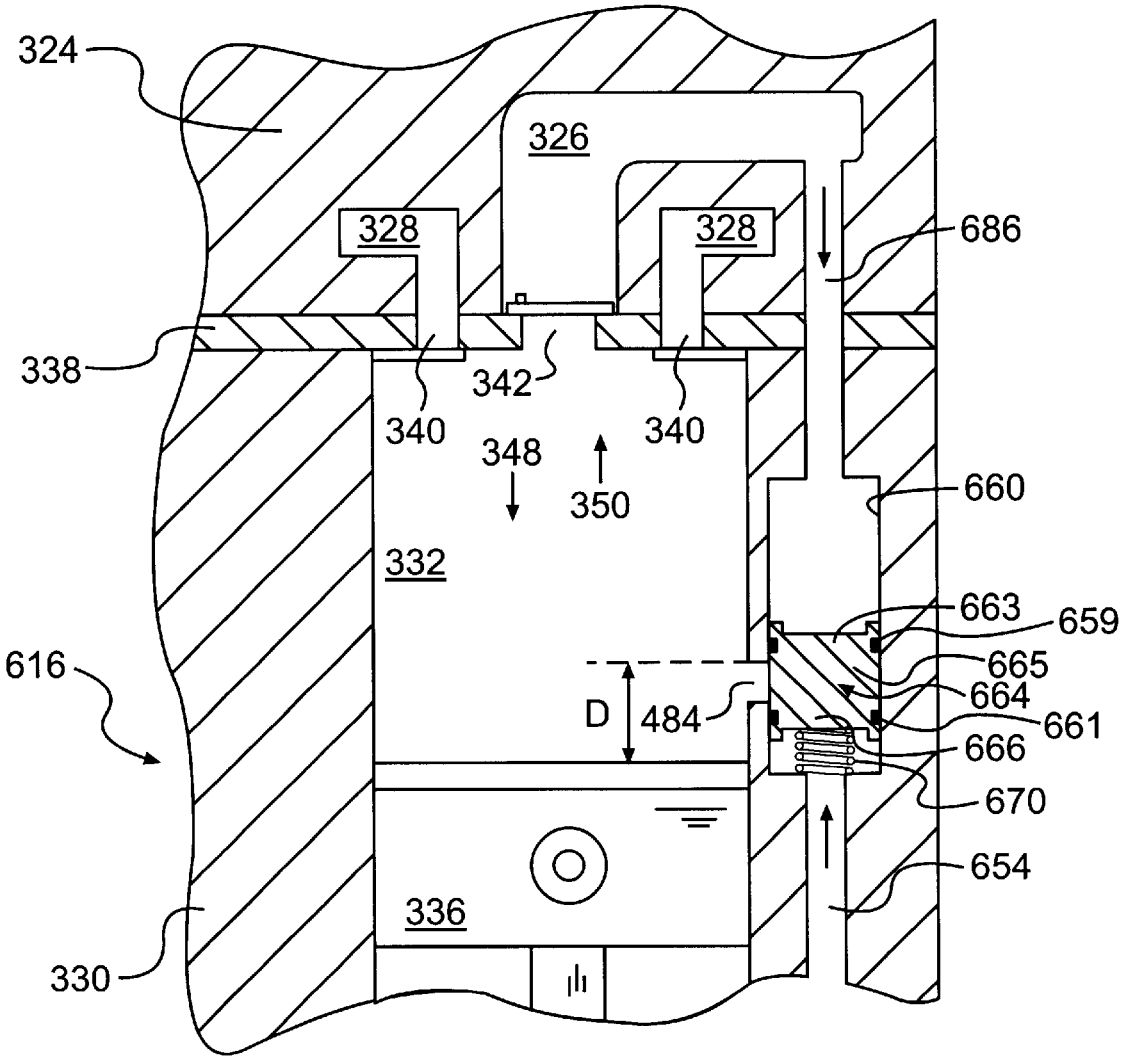
FIG. 18 is a partial section view of the embodiment of FIG. 17, showing the valve member in a position to prevent flow through the flow passage.

FIGS. 17 and 18 illustrate yet another embodiment of a reciprocating compressor of the present invention. In the illustrated embodiment, a reciprocating compressor 616 includes a valve chamber 660 formed in the crankcase 330 next to the compression chamber 332. The valve chamber 660 is in fluid communication with the compression chamber 332 through the opening 484 formed on a side surface of the compression chamber 332. The valve chamber 660 is also in fluid communication with the suction channel 328 through a flow passage 654. Thus, the flow passage 654 is in fluid communication with the compression chamber 332 through the opening 484. The opening 484 is formed between a bottom dead center position and a top dead center position of the reciprocating piston 336. The top of the opening 484 is formed a predetermined distance D away from the top surface of the reciprocating piston 336 in its bottom dead center position.

A valve member 664 is disposed within the valve chamber 660. The valve member 664 controls the flow of the fluid between the compression chamber 332 and the suction channel 328 by permitting and preventing flow through the flow passage 654. The valve member 664 is movable between a first position permitting flow through the flow passage 654 (FIG. 17) and a second position preventing flow through the flow passage 654 (FIG. 18).

The valve member 664 includes a head portion 663, a tail portion 666, and a stem portion 665 connecting the head and tail portion 663 and 666. Preferably, the head portion 663, the tail portion 666, and the stem portion 665 are circular in cross section and have the same diameter. The side surfaces of the head and tail portions 663 and 665 respectively have sealing members 659 and 661, such as o-rings or flip seals, provided therein for a sealing contact with the inner surface of the valve chamber 660.

As illustrated in FIGS. 17 and 18, the head portion 663 of the valve member 664 is exposed continuously to the discharge pressure of the fluid through a flow passage 686, which is in fluid communication with the discharge channel 326. Accordingly, the fluid at the discharge pressure continuously acts on the head portion 663 and continuously exerts a force in a direction such that the valve member 664 prevents flow through the flow passage 654.

As illustrated in FIG. 17, when the valve member 664 is in the first position permitting flow through the flow passage 654, the tail portion 666 of the valve member 664 is exposed continuously to the suction pressure of the fluid through the flow passage 684, which is in fluid communication with the suction channel 328, as well as through the opening 484, which is in fluid communication with the compression chamber 332. However, as illustrated in FIG. 18, when the valve member 664 is in the second position preventing flow through the flow passage 654, the tail portion 666 of the valve member 664 is exposed continuously to the suction pressure of the fluid only through the flow passage 654. In both configurations, the fluid at the suction pressure continuously acts on the tail portion 666 and continuously exerts a force in a direction such that the valve member 664 permits flow through the flow passage 654.

In addition, a biasing member 670, such as a coil spring, is provided to exerts a biasing force in a direction such that the valve member 664 permits flow through the flow passage 654. Accordingly, the biasing force of the biasing member 670 and the force exerted by the suction pressure combine to oppose the force exerted by the discharge pressure.

As illustrated in FIG. 17, when the force exerted by the discharge pressure is less than the combined force (i.e., the biasing force of the biasing member 670 plus the force exerted by the suction pressure), the valve member 664 is in the first position and permits flow through the opening 484 and the flow passage 654 to the suction channel 328. When the valve member 664 is in the first position, the reciprocating compressor 616 operates in a reduced capacity mode. In this mode, the fluid in the compression chamber 332 flows back through the opening 484, into flow passage 654, and even into the suction channel 328 in the manifold 324. Similar to the reexpansion chamber described with regard to the embodiments illustrated in FIGS. 8–11, these elements are in effect combined to provide a reexpansion area in fluid communication with the compression chamber. In effect, the fluid in the compression chamber is not compressed beyond the suction pressure, until the reciprocating piston travels beyond the opening 484.

As the reciprocating piston 336 moves in the compression stroke 350 from its bottom dead center position toward its top dead center position, the fluid within the compression chamber 332 is discharged to the suction channel 328 through the opening 484, valve chamber 660, and flow passage 654. This discharge to the suction channel 328 continues until the top surface of the reciprocating piston 336 reaches the top of the opening 484 and closes the opening 484. In other words, until the reciprocating piston 336 moves the predetermined distance D from its bottom dead center position, no or little compression results. After the top surface of the reciprocating piston 336 reaches the top of the opening 484 and closes the opening 484, significant compression begins. Accordingly, the reciprocating compressor 616 effectively reduces the stroke length of the reciprocating piston 336 and therefore operates in a reduced capacity mode.

As illustrated in FIG. 18, however, when the discharge pressure reaches a predetermined level, the force exerted by the discharge pressure overcomes the combined force (i.e., the biasing force of the biasing member 770 plus the force exerted by the suction pressure) and moves the valve member 664 to the second position. When the valve member 664 is in the second position preventing flow through the flow passage 654, the reciprocating compressor 616 operates in a full capacity mode because no fluid exits the compression chamber 332 through the flow passage 654. In other words, the full stroke length of the reciprocating piston 336 is utilized to compress the fluid entering and exiting the compression chamber 332 through the inlet 340 and outlet 342.

As illustrated in FIG. 18, when the valve member 664 is in the second position, the stem portion 665 blocks the opening 484 and prevents flow through the opening 484 and the flow passage 654 to the suction channel 328. Compared with the embodiment illustrated in FIGS. 12 and 13 where the valve member 464 moves perpendicular to the movement of the reciprocating piston 336, the valve member 664 in the embodiment illustrated in FIGS. 17 and 18 moves parallel with the movement of the reciprocating piston 336. In the embodiment illustrated in FIGS. 12 and 13, the pressure in the compression chamber 332 exerts a net force on the front surface of the stem portion 465 when the valve member 464 is in the second position. That net force, which is exerted in the direction of the movement of the valve member 464, changes as the pressure in the compression chamber 332 varies between the suction pressure and an intermediate pressure achieved when the reciprocating piston 336 reaches the opening 484 from its bottom dead center position. However, in the embodiment illustrated in FIGS. 17 and 18, when the valve member 664 is in the second position, the pressure in the compression chamber 332 exerts no net force on the valve member 664 in the direction of the movement of the valve member 664. In other words, when the valve member 664 is in the second position, the increase in pressure from the suction pressure to the intermediate pressure achieved when the reciprocating piston 336 reaches the opening 484 has no impact on the valve member 664 because the valve member 664 moves parallel with the movement of the reciprocating piston 336. Accordingly, the embodiment illustrated in FIGS. 17 and 18 eliminates any instability problem that may exist in the embodiment illustrated in FIGS. 12 and 13.

By adjusting the location of the opening 484 relative to the bottom dead center position of the reciprocating piston 336, the reciprocating compressor 616 achieves a desired capacity modulation. Also, by adjusting the biasing force exerted by the biasing member 670, the reciprocating compressor 616 controls the discharge pressure at which valve member 664 prevents flow through the flow passage 654. Accordingly, as explained in relation to the embodiments illustrated in FIGS. 8–11, the system efficiency of an air-conditioning or refrigeration system can be improved by optimizing the combination of the degree of capacity modulation and the pressure at which the valve member 664 prevents flow through the flow passage 654. Preferably, the location of the opening 484 is adjusted such that the reduced capacity is 70 to 90% of the full capacity. Also, for example, an outside air temperature in the range of 75 to 94° F. may be utilized as the predetermined value above which the valve member 664 prevents flow through the flow passage 654.

Figure 19:
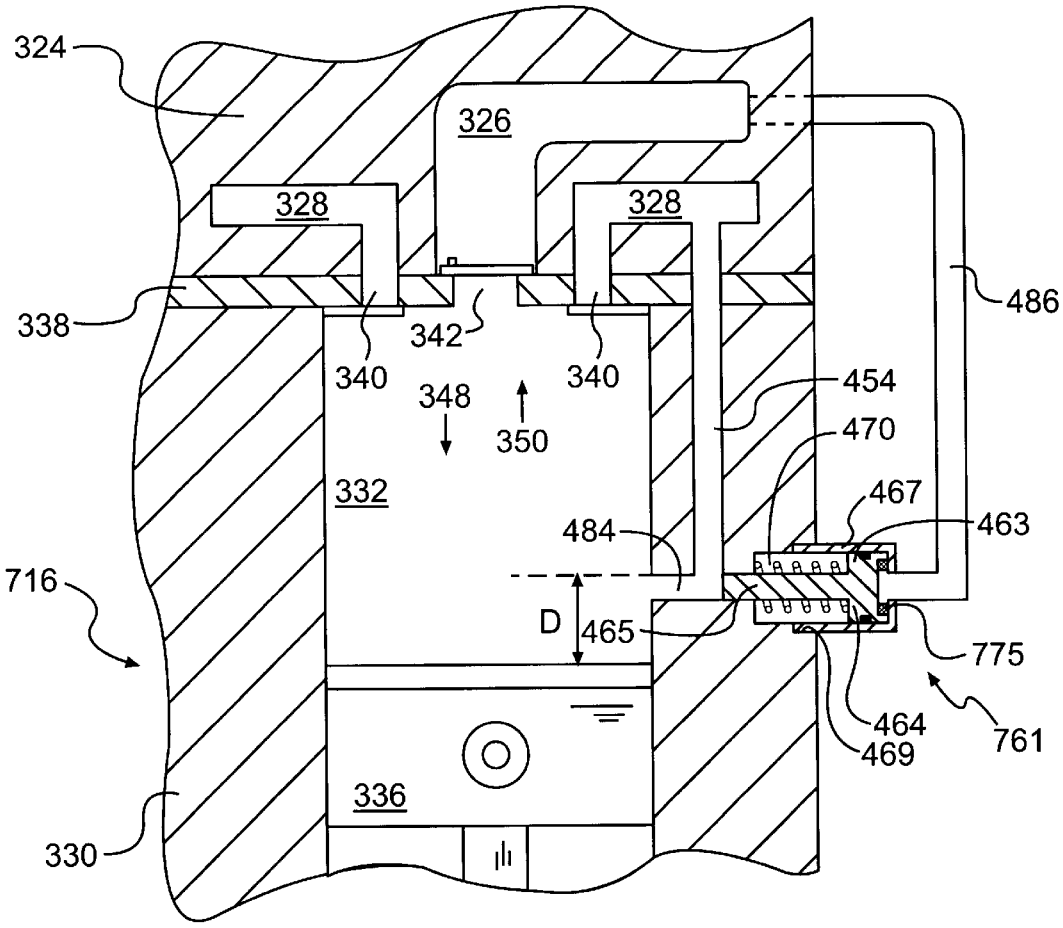
FIG. 19 is a partial section view of yet another embodiment of the present invention, incorporated in a reciprocating compressor for an air-conditioning or refrigeration system.
Figure 20:
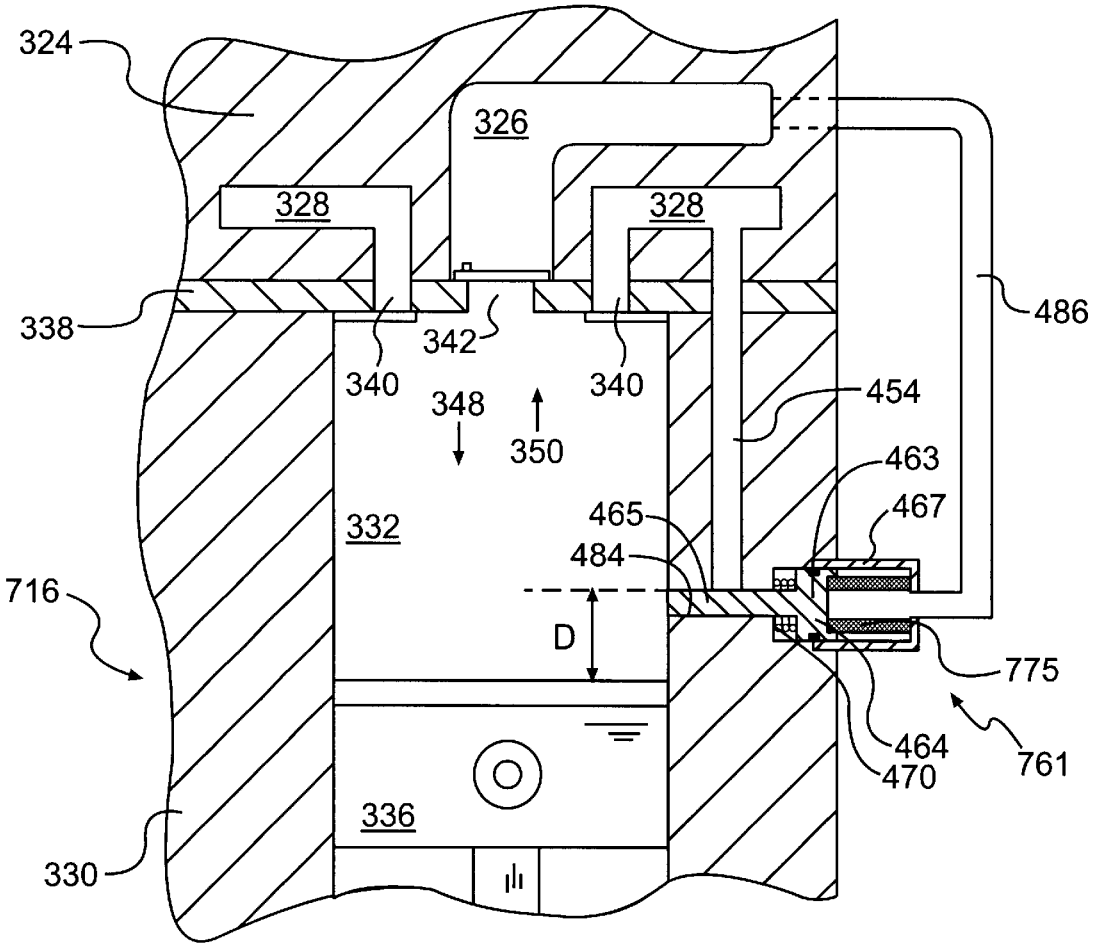
FIG. 20 is a partial section view of the embodiment of FIG. 19, showing the valve member in a position to prevent flow through the flow passage.

FIGS. 19 and 20 illustrate yet another embodiment of a reciprocating compressor of the present invention. In the illustrated embodiment, a reciprocating compressor 716 includes a valve mechanism 761. The valve mechanism 761 includes a temperature element 775. For the purposes of the following description, the term "temperature element" refers to a material or a combination of materials that changes volume or shape as a function of temperature.

Compared with the embodiment illustrated in FIGS. 12 and 13 where the pressure controls the capacity modulation, temperature controls the capacity modulation in the embodiment illustrated in FIGS. 19 and 20. As illustrated in FIGS. 19 and 20, in addition to the structures included in valve mechanism 461 illustrated in FIGS. 12 and 13, the valve mechanism 761 includes the temperature element 775. The temperature element 775 is positioned between the head portion 463 of the valve member 464 and the cap 467 and is exposed continuously to the discharge temperature of the fluid through the feed line 486. As the temperature of element 775 changes, it exerts a varying force on the head portion 463 of the valve member 464, as it expands/contracts or changes its shape. Therefore, a thermal force, which varies in magnitude as a function of the discharge temperature, is exerted on the head portion 463 of the valve member 464 in addition to the force exerted by the discharge pressure on the valve member 464.

In the embodiment illustrated in FIGS. 19 and 20, the spring constant of the biasing member 470 is adjusted such that, at a predetermined operating condition of the fluid, the force exerted by the discharge pressure alone is not enough to overcome the combined force (i.e., the biasing force of the biasing member 470 plus the force exerted by the suction pressure). However, at the predetermined operating condition of the fluid, the thermal force of the temperature element 775 combined with the force exerted by the discharge pressure overcomes the opposing force to move the valve member 464 to the second position illustrated in FIG. 20. Accordingly, when the fluid reaches the predetermined operating condition, the discharge pressure and temperature cause the valve member 464 to move from the first position (FIG. 19) to the second position (FIG. 20). The temperature element 775 may be secured to the head portion 463 and the cap 467. Alternatively, the temperature element 775 may be positioned to abut the head portion 463 and the cap 467 without being secured thereto.

Figure 22:
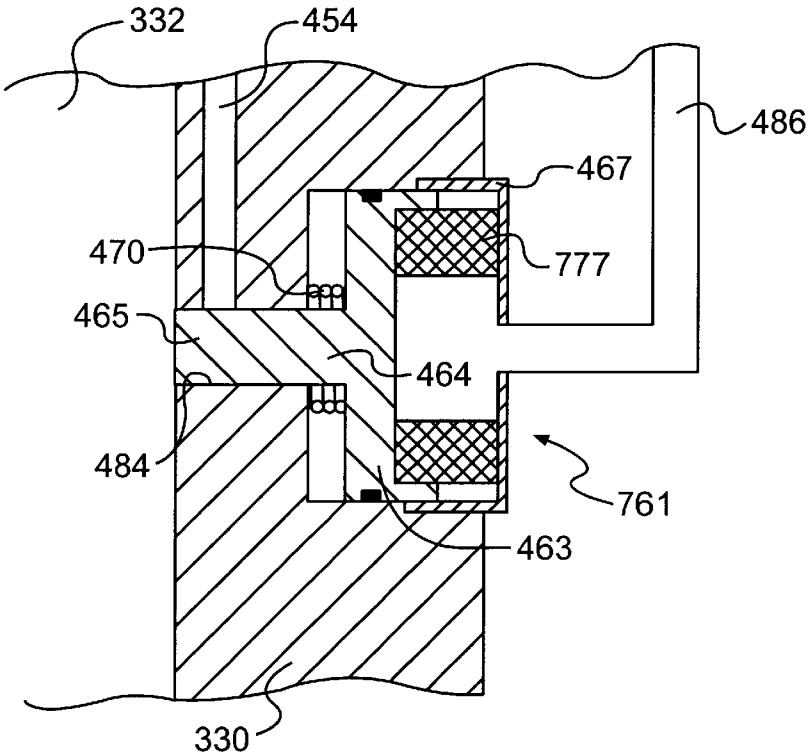
FIG. 22 is a partial section view of the embodiment of FIG. 21, showing the valve member in a position to prevent flow through the flow passage.
Figure 21:
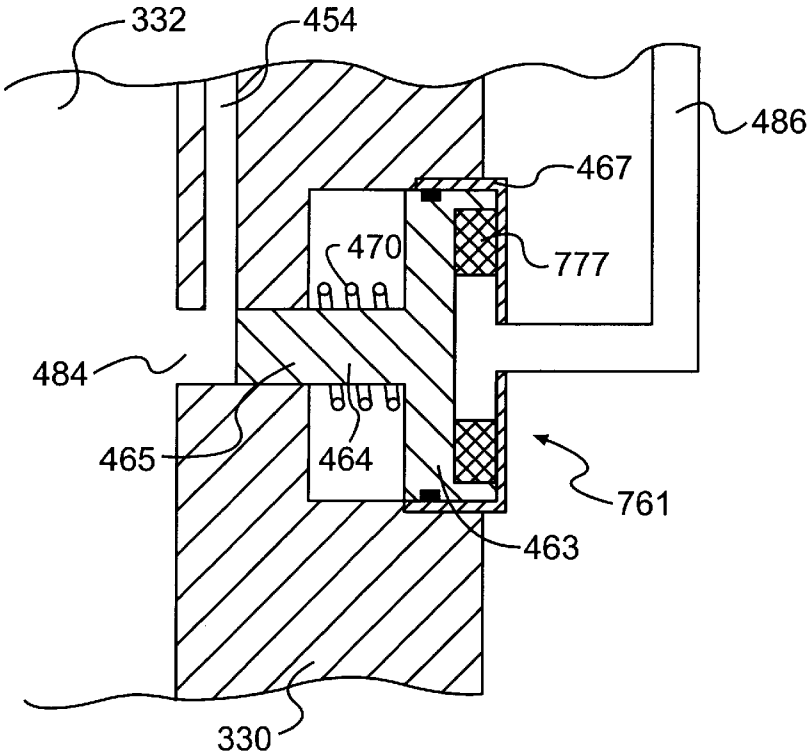
FIG. 21 is a partial section view of an embodiment of a temperature element of the present invention applied to a valve member.
Figure 24:
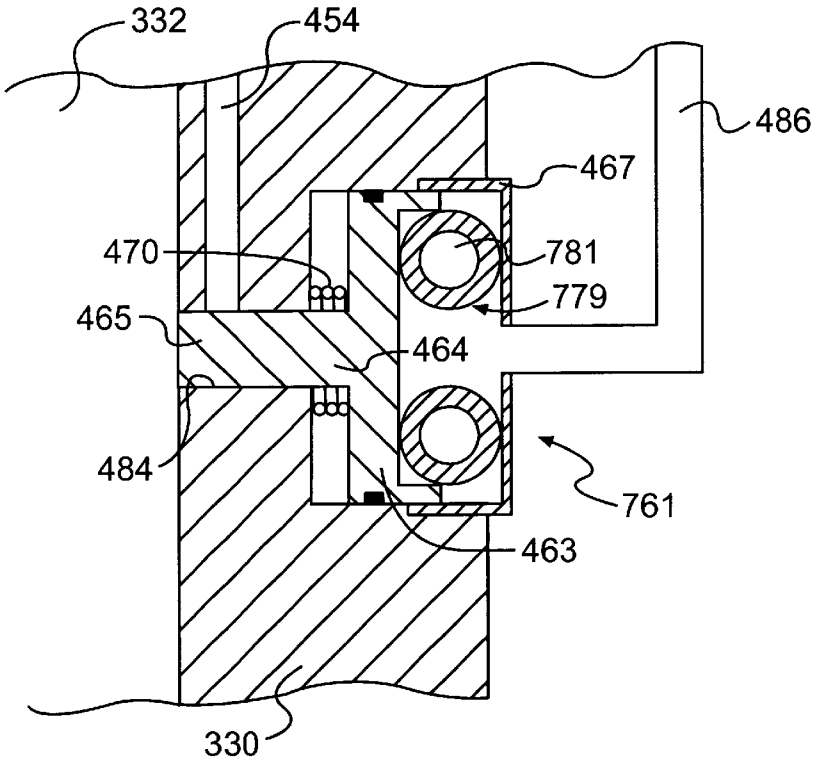
FIG. 24 is a partial section view of the embodiment of FIG. 23, showing the valve member in a position to prevent flow through the flow passage.
Figure 23:
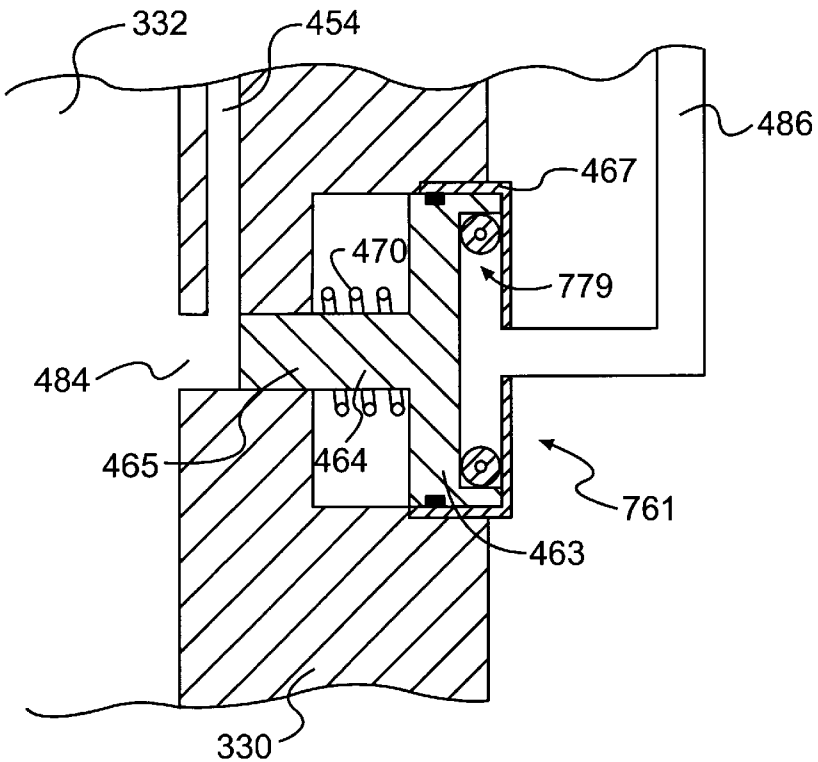
FIG. 23 is a partial section view of another embodiment of a temperature element of the present invention applied to a valve member.

As illustrated in FIGS. 21 and 22, the temperature element 775 may be a wax 777 or other material that changes volume as the temperature changes. Preferably, the wax material 777 is annular in shape. Alternatively, as illustrated in FIGS. 23 and 24, the temperature element 775 may be a bladder 779. The bladder 779 has a hollow enclosure 781 filled with gas. As the temperature changes, the gas within the hollow enclosure 781 expands or contracts to exert a thermal force on the head portion 463. Preferably, the bladder 779 is toroidal (i.e., donut-like) in shape and has a refrigerant as the gas that fills the hollow enclosure 781.

Figure 26:
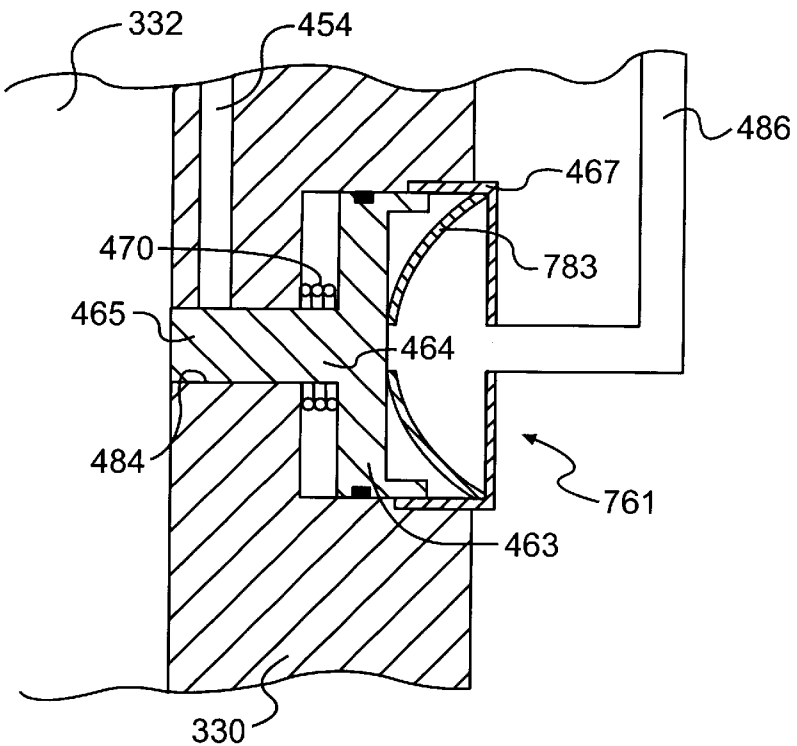
FIG. 26 is a partial section view of the embodiment of FIG. 25, showing the valve member in a position to prevent flow through the flow passage.
Figure 25:
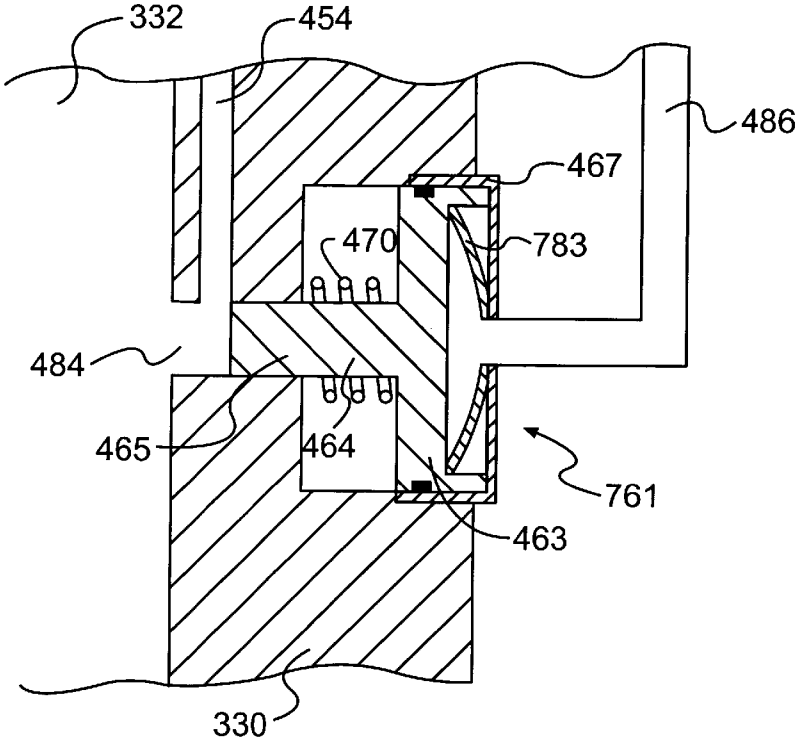
FIG. 25 is a partial section view of yet another embodiment of a temperature element of the present invention applied to a valve member.

Alternatively, as illustrated in FIGS. 25 and 26, the temperature element 775 may be a bi-metal disk 783. As the temperature changes, the bi-metal disk 783 changes its shape and changes the magnitude of the thermal force exerted on the head portion 463. For example, when the fluid reaches the predetermined operating condition having a predetermined temperature, the bi-metal disk 783 snaps to provide the thermal force necessary to move the valve member 464 from the first position (FIG. 25) to the second position (FIG. 26). A plurality of disks may be stacked together to provide the necessary thermal force when the fluid reaches the predetermined operating condition.

Figure 28:
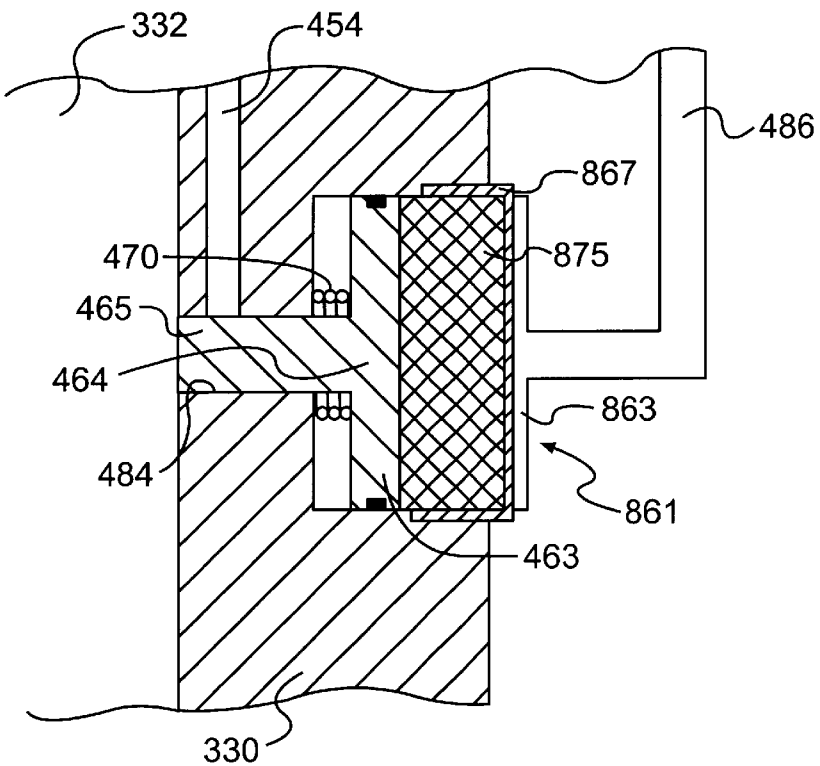
FIG. 28 is a partial section view of the embodiment of FIG. 27, showing the valve member in a position to prevent flow through the flow passage.
Figure 27:
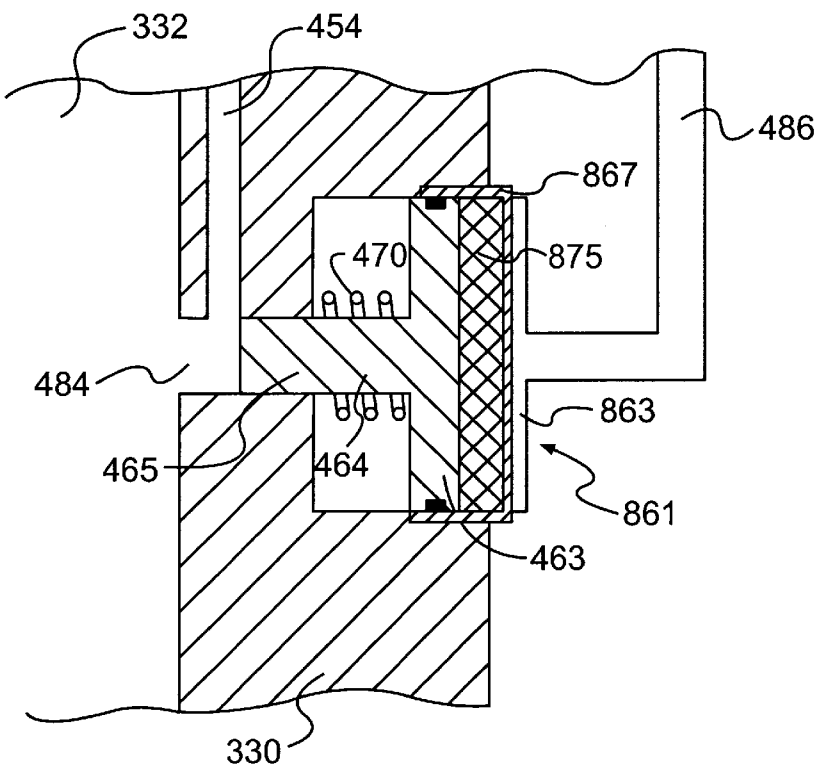
FIG. 27 is a partial section view of yet another embodiment of the present invention, incorporated in a reciprocating compressor for an air-conditioning or refrigeration system.

Preferably, as illustrated in FIGS. 19–26, the temperature element 775 is in direct contact with the fluid at the discharge temperature for heat transfer therebetween. Alternatively, however, as illustrated in FIGS. 27 and 28, a valve mechanism 861 may include a cap 867, which has no opening. Because the cap 867 has no opening, a direct contact between the fluid at the discharge temperature and a temperature element 875 is not permitted. In this embodiment, the heat transfer between the temperature element 875 and the fluid at the discharge temperature occurs indirectly through the cap 867. In this embodiment, to assist the heat transfer between the fluid and the temperature element 875 through the cap 867, the feed line 486 may have an enlarged opening 863 where the feed line 486 connects to the cap 867. The enlarged opening 863 increases the heat transfer surface and thereby increases the heat transfer between the temperature element 875 and the fluid at the discharge temperature.

In the embodiment illustrated in FIGS. 27 and 28, the spring constant of the biasing member 470 is adjusted such that, at a predetermined operating condition of the fluid, the thermal force of the temperature element 875 alone is sufficient to overcome the opposing force (i.e., the biasing force of the biasing member 470 plus the force exerted by the suction pressure) to move the valve member 464 to the second position illustrated in FIG. 28. Accordingly, when the fluid reaches the predetermined operating condition, the discharge temperature alone causes the valve member 464 to move from the first position (FIG. 27) to the second position (FIG. 28).

For the temperature element 875, the embodiments illustrated in FIGS. 21–26 may be used. The temperature element 875 may be different in shape from the temperature elements illustrated in FIGS. 21–26 because the fluid need not directly contact the head portion 463 of the valve member 464. For example, the temperature element 875 may be circular in shape.

FIGS. 19 through 28 illustrate temperature elements applied to an embodiment of a reciprocating compressor described in FIGS. 12 and 13. However, the temperature elements illustrated in FIGS. 19 through 28 may also be applied to other embodiments of the compressors described in FIGS. 1–6, 8–11, and 14–18.

In several of the embodiments illustrated above, the valve member is subjected to the suction and discharge pressures of the compressor. Alternatively, however, the valve member may be subjected to one or more intermediate pressures between the suction and discharge pressures. In other words, the valve member may be subjected to (1) the suction pressure on one side and an intermediate pressure on the other side, (2) an intermediate pressure on one side and the discharge pressure on the other side, or (3) two different intermediate pressures on opposite sides. In a reciprocating compressor, an intermediate pressure may be obtained from a compression chamber through an opening formed between the bottom and top dead center positions of the reciprocating piston. Similarly, in a rotary compressor, an intermediate pressure may be obtained from a compression chamber through an opening formed between a suction inlet and a discharge outlet. In a scroll compressor, an intermediate pressure may be obtained through an opening formed in the fixed scroll member and aligned with any of the moving compression chambers.

In summary, the present invention may be applied to a variety of different compressors, including but not limited to rotary, reciprocating, or scroll compressors. In each instance, the invention can provide a compressor that will automatically self-adjust or modulate its capacity from a first capacity to a second capacity, based on operating parameters of the compressor and/or the HVAC system, and without any controls outside the compressor. The compressor preferably is incorporated in an HVAC system and is turned on or off by a standard thermostat. Once the compressor is turned on, it will self modulate its capacity, as conditions change. Whenever, the desired conditioning of the served space is achieved, the thermostat will turn the compressor off.

In several of the embodiments, the invention includes a valve member that is subjected to a first operating condition of the fluid on one side and a second operating condition of the fluid on the other side. The changes in the first and second operating conditions of the fluid cause the valve member to move between a first position and a second position. When the valve member is in the first position, the compressor operates at a reduced capacity, because fluid is allowed to bleed off to a reexpansion area or chamber. When the valve member is in the second position, the compressor operates at an increased, or a maximum, capacity. By using two or more valve members and associated reexpansion areas or chambers, the present invention can provide an automatically modulated compressor having more than two capacities. Varying the positioning of the opening(s) served by the valve member(s) or the size and/or shape of the reexamination chamber can vary the degree of difference between one capacity and another.

In yet other embodiment, the self modulation of the compressor is achieved by incorporating a temperature sensitive element in the compressor, that will change in size or shape as operating temperatures of the compressor changes. This change in size and shape is then applied to open or close a valve, or otherwise actuate an element, to vary the capacity of the compressor.

It will be apparent to those skilled in the art that various modifications and variations can be made without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A variable compressor comprising:

a compression chamber;

a reexpansion area;

a flow channel between the compression chamber and the reexpansion area; and a valve member continuously and opposingly subjected to first and second operating conditions of the compressor and movable between first and second positions as a function of the first and second operating conditions, the valve member in the first position allowing flow between the compression chamber and the reexpansion area and the valve member in the second position preventing flow between the compression chamber and the reexpansion area, whereby the compressor operates at a first capacity when the valve member is in the first position and at a second, increased capacity when the valve member is in the second position.

2. The variable compressor of claim 1, wherein the first and second operating conditions are suction and discharge conditions of the compressor.

3. The variable compressor of claim 2, wherein the valve member moves from the first position to the second position when a discharge pressure of the compressor reaches a predetermined value relative to a suction pressure of the compressor.

4. The variable compressor of claim 3, wherein the suction pressure of the compressor is applied to one side of the valve member and the discharge pressure of the compressor is applied to an opposite side of the valve member.

5. The variable compressor of claim 4, wherein a biasing member is applied against the valve member, biasing the valve member toward the first position.

6. The variable compressor of claim 5, wherein the biasing member and the suction pressure are applied to push the valve member toward the first position and the discharge pressure is applied to push the valve member toward the second position.

7. The variable compressor of claim 2, wherein the valve member moves from the first position to the second position when a discharge temperature of the compressor reaches a predetermined value.

8. A variable compressor, comprising:

a compression chamber;

a reexpansion area;

a flow channel between the compression chamber and the reexpansion area;

a valve member movable between first and second positions, the valve member in the first position allowing flow between the compression chamber and the reexpansion area and the valve member in the second position preventing flow between the compression chamber and the reexpansion area, whereby the compressor operates at a first capacity when the valve member is in the first position and at a second, increased capacity when the valve member is in the second position; and a control, associated only with the compressor, for moving the valve member between the first and second positions as a function of an operating parameter of the compressor, whereby the compressor is automatically modulated based on the operating parameter, wherein the operating parameter is temperature, wherein the valve member moves from the first position to the second position when a discharge temperature of the compressor reaches a predetermined value, and wherein a suction pressure of the compressor is applied to one side of the valve member and a temperature element is applied to an opposite side of the valve member.

9. The variable compressor of claim 8, wherein a biasing member is applied against the valve member, biasing the valve member toward the first position.

10. The variable compressor of claim 9, wherein a discharge pressure of the compressor is applied to the opposite side of the valve member.

11. The variable compressor of claim 10, wherein the biasing member and the suction pressure are applied to push the valve member toward the first position and the discharge pressure and the temperature element are applied to push the valve member toward the second position.

12. A compressor, comprising:

a compression chamber;

a compressing member movable to compress fluid entering the compression chamber;

a flow passage in fluid communication with the compression chamber at one end and a reexpansion area at the other end;

a valve member associated with the flow passage and movable between a first position permitting flow through the flow passage and a second position preventing flow through the flow passage, the valve member being continuously subjected to a first operating condition of the fluid such that a first force is continuously exerted on the valve member in a first direction, the valve member being continuously subjected to a second operating condition of the fluid such that a second force is continuously exerted on the valve member in a second direction opposite to the first direction; and a biasing member exerting a biasing force on the valve member in the second direction such that when the first force overcomes the biasing force and the second force combined together, the valve member moves from the first position to the second position and modulates the capacity of the compressor.

13. The compressor of claim 12, wherein the first operating condition of the fluid is a discharge condition of the fluid.

14. The compressor of claim 13, wherein the discharge condition of the fluid has a discharge pressure and a change in the discharge pressure causes the valve member to move between the first and second positions.

15. The compressor of claim 14, wherein the compressor is a reciprocating compressor including a reciprocating piston as the compressing member.

16. The compressor of claim 15, wherein the valve member moves perpendicular to the movement of the reciprocating piston.

17. The compressor of claim 15, wherein the valve member moves parallel with the movement of the reciprocating piston.

18. The compressor of claim 15, wherein the reexpansion area is a reexpansion chamber formed in a crankcase of the reciprocating compressor.

19. The compressor of claim 18, wherein the flow passage is defined by a valve plate mounted on the crankcase and a recess formed in the crankcase.

20. The compressor of claim 18, wherein the flow passage is formed in the crankcase.

21. The compressor of claim 18, wherein the valve member is positioned within the reexpansion chamber.

22. The compressor of claim 15, wherein the reexpansion area includes a suction channel of the reciprocating compressor.

23. The compressor of claim 22, wherein the flow passage is located between a bottom dead center position and a top dead center position of the reciprocating piston.

24. The compressor of claim 14, wherein the compressor is a scroll compressor and the compressing member is a movable scroll member.

25. The compressor of claim 24, wherein the flow passage is formed in a fixed scroll member intermeshed with the movable scroll member.

26. The compressor of claim 24, wherein the reexpansion area includes a suction channel of the scroll compressor.

27. The compressor of claim 14, wherein the valve member includes a head portion exposed continuously to the discharge pressure and a stem portion connected to the head portion.

28. The compressor of claim 27, wherein the valve member further includes a projection formed on the head portion and the projection has a surface not exposed to the discharge pressure when the valve member is in the first position and exposed to the discharge pressure when the valve member is in the second position.

29. The compressor of claim 27, wherein the head portion is configured to prevent flow through the flow passage when the valve member is in the second position.

30. The compressor of claim 27, wherein the valve member further includes a tail portion connected to the stem portion and the tail portion is exposed continuously to a suction pressure of the fluid.

31. The compressor of claim 30, wherein the head, tail, and stem portions are circular in shape and have the same diameter.

32. The compressor of claim 27, wherein the stem portion is configured to prevent flow through the flow passage when the valve member is in the second position.

33. The compressor of claim 32, wherein the stem portion includes a front surface exposed continuously to the fluid in the compression chamber.

34. The compressor of claim 13, wherein the second operating condition of the fluid is a suction condition of the fluid.

35. The compressor of claim 13, wherein the second operating condition of the fluid is a condition of the fluid in the compression chamber.

36. A compressor, comprising:

a compression chamber;

a compressing member movable to compress fluid entering the compression chamber;

a flow passage in fluid communication with the compression chamber at one end and a reexpansion area at the other end;

a valve member associated with the flow passage and movable between a first position permitting flow through the flow passage and a second position preventing flow through the flow passage, the valve member being continuously subjected to a first operating condition of the fluid such that a first force is continuously exerted on the valve member in a first direction, the valve member being continuously subjected to a second operating condition of the fluid such that a second force is continuously exerted on the valve member in a second direction opposite to the first direction;

a biasing member exerting a biasing force on the valve member in the second direction such that when the first force overcomes the biasing force and the second force combined together, the valve member moves from the first position to the second position and modulates the capacity of the compressor; and a temperature element to exert a thermal force on the valve member in the first direction, wherein the first operating condition of the fluid is a discharge condition of the fluid having a discharge pressure and a discharge temperature, and a change in the discharge temperature causes the valve member to move between the first and second positions.

37. The compressor of claim 36, wherein the valve member is exposed to the discharge pressure to exert a force on the valve member in the first direction such that the first force exerted on the valve member is the thermal force exerted by the temperature element plus the force exerted by the discharge pressure.

38. The compressor of claim 37, wherein the temperature element is an element that expands as it is heated.

39. The compressor of claim 37, wherein the temperature element is a bladder having a hollow enclosure and gas is filled in the hollow enclosure.

40. The compressor of claim 39, wherein the gas is a refrigerant.

41. The compressor of claim 37, wherein the temperature element includes at least one bi-metal disk.

42. The compressor of claim 36, wherein the valve member is not exposed to the discharge pressure and the first force exerted on the valve member is the thermal force exerted by the temperature element.

43. A heat exchanging system having fluid flowing therethrough in a cycle, comprising:

a condenser;

an expansion device in fluid communication with the condenser;

an evaporator in fluid communication with the expansion device;

a compressor in fluid communication with the evaporator and the condenser, the compressor including an actuating element continuously and opposingly subjected to first and second operating conditions of the fluid and movable between a first position and a second position as a function of the first and second operating conditions, such that the compressor operates at a first capacity when the actuating element is in the first position and at a second capacity when the actuating element is in the second position; and a control for turning the compressor on or off, based on the demand for heating or cooling.

44. The heat exchanging system of claim 43, wherein the first and second operating conditions are suction and discharge conditions and a relative change in the suction and discharge conditions causes the actuating element to move between the first and second positions.

45. The heat exchanging system of claim 44, wherein the compressor is a reciprocating compressor.

46. A method of operating a variable capacity compressor, the method comprising the steps of:

operating the compressor at a first capacity;

continuously and opposingly applying first and second pressures to a movable component in the compressor, the movable component causing the compressor to operate at the first capacity when the movable component is in a first position and at a second increased capacity when the movable component is in a second position; and applying a biasing force to bias the movable component toward the first position, such that the movable component moves to the second position when the relative differential between the first and second pressures reaches a predetermined value, whereby the compressor automatically modulates its capacity based on the relative values of the first and second pressures.

47. The method of claim 46, wherein the first and second pressures are suction and discharge pressures.

48. The method of claim 47, wherein the compressor includes a reexpansion area and a flow passage in fluid communication with a compression chamber at one end and the reexpansion area at the other end, and wherein the movable component in the first position permits flow through the flow passage and in the second position prevents flow through the flow passage.

49. The method of claim 48, wherein the compressor is a reciprocating compressor and the reexpansion area is a reexpansion chamber formed in a crankcase of the reciprocating compressor.

50. The method of claim 48, wherein the compressor is a reciprocating compressor and the reexpansion area includes a suction channel of the reciprocating compressor.

51. The method of claim 48, wherein the compressor is a scroll compressor and the reexpansion area includes a suction channel of the scroll compressor.

52. A method of operating a variable capacity compressor, the method comprising the steps of:

operating the compressor at a first capacity;

applying first and second pressures to a movable component in the compressor, the movable component causing the compressor to operate at the first capacity when the movable component is in a first position and at a second increased capacity when the movable component is in a second position; and applying a biasing force to bias the movable component toward the first position, such that the movable component moves to the second position when the relative differential between the first and second pressures reaches a predetermined value, whereby the compressor automatically modulates its capacity based on the relative values of the first and second pressures, wherein the compressor is in fluid communication with a condenser exposed to outside air and the method further comprises the step of selecting the biasing force such that the movable component moves to the second position when the temperature of the outside air is greater than a predetermined temperature.

53. The method of claim 52, wherein the predetermined temperature is in the range of 75 to 94° F.

54. A capacity modulation method, comprising the steps of:

providing a compressor comprising a compression chamber and a compressing member movable to compress fluid entering the compression chamber;

providing a flow passage in fluid communication with the compression chamber at one end and a reexpansion area at the other end;

providing a valve member associated with the flow passage and movable between a first position permitting flow through the flow passage and a second position preventing flow through the flow passage;

subjecting the valve member continuously to a first operating condition of the fluid such that a first force is continuously exerted on the valve member in a first direction;

subjecting the valve member continuously to a second operating condition of the fluid such that a second force is continuously exerted on the valve member in a second direction opposite to the first direction; and exerting a biasing force on the valve member in the second direction such that when the first force overcomes the second force and the biasing force combined together, the valve member moves from the first position to the second position and thereby modulates the capacity.

55. The method of claim 54, wherein the first operating condition of the fluid is a discharge condition of the fluid.

56. The method of claim 55, wherein the second operating condition of the fluid is a suction condition of the fluid.

57. The method of claim 56, wherein one side of the valve member is exposed to a discharge pressure of the fluid and an opposite side of the valve member is exposed to a suction pressure of the fluid.

58. The method of claim 54, wherein the second operating condition of the fluid is a condition of the fluid in the compression chamber.

59. The method of claim 58, wherein one side of the valve member is exposed to a discharge pressure of the fluid and an opposite side of the valve member is exposed to a pressure of the fluid in the compression chamber.

60. A capacity modulation method, comprising the steps of:

providing a compressor comprising a compression chamber and a compressing member movable to compress fluid entering the compression chamber;

providing a flow passage in fluid communication with the compression chamber at one end and a reexpansion area at the other end;

providing a valve member associated with the flow passage and movable between a first position permitting flow through the flow passage and a second position preventing flow through the flow passage;

subjecting the valve member continuously to a first operating condition of the fluid such that a first force is continuously exerted on the valve member in a first direction;

subjecting the valve member continuously to a second operating condition of the fluid such that a second force is continuously exerted on the valve member in a second direction opposite to the first direction; and exerting a biasing force on the valve member in the second direction such that when the first force overcomes the second force and the biasing force combined together, the valve member moves from the first position to the second position and thereby modulates the capacity, wherein the compressor further includes a temperature element associated with the valve member and the temperature element is subjected to the first operating condition to exert a thermal force on the valve member in the first direction.

61. The method of claim 60, wherein the first operating condition of the fluid is a discharge condition of the fluid.

62. The method of claim 61, wherein the second operating condition of the fluid is a suction condition of the fluid.

63. The method of claim 62, wherein the fluid at the first operating condition contacts the temperature element.

64. The method of claim 63, wherein one side of the valve member is exposed to a discharge pressure of the fluid such that the first force exerted on the valve member is the thermal force exerted by the temperature element plus a force exerted by the discharge pressure, and an opposite side of the valve member is exposed to a suction pressure of the fluid such that the suction pressure exerts the second force on the valve member.

65. The method of claim 62, wherein the fluid at the first operating condition does not contact the temperature element.

66. The method of claim 65, wherein the first force exerted on the valve member is the thermal force exerted by the temperature element and one side of the valve member is exposed to a suction pressure of the fluid such that the suction pressure exerts the second force on the valve member.

67. The method of claim 61, wherein the second operating condition of the fluid is a condition of the fluid in the compression chamber.

68. The method of claim 67, wherein the fluid at the first operating condition contacts the temperature element.

69. The method of claim 68, wherein one side of the valve member is exposed to a discharge pressure of the fluid such that the first force exerted on the valve member is the thermal force exerted by the temperature element plus a force exerted by the discharge pressure, and an opposite side of the valve member is exposed to a pressure of the fluid in the compression chamber such that the pressure of the fluid in the compression chamber exerts the second force on the valve member.

70. The method of claim 67, wherein the fluid at the first operating condition does not contact the temperature element.

71. The method of claim 70, wherein the first force exerted on the valve member is the thermal force exerted by the temperature element and one side of the valve member is exposed to a pressure of the fluid in the compression chamber such that the pressure of the fluid in the compression chamber exerts the second force on the valve member.

72. A capacity modulation method, comprising the steps of:

providing a compressor comprising a compression chamber and a compressing member movable to compress fluid entering the compression chamber;

providing a flow passage in fluid communication with the compression chamber at one end and a reexpansion area at the other end;

providing a valve member associated with the flow passage and movable between a first position permitting flow through the flow passage and a second position preventing flow through the flow passage;

subjecting the valve member continuously to a first operating condition of the fluid such that a first force is continuously exerted on the valve member in a first direction;

subjecting the valve member continuously to a second operating condition of the fluid such that a second force is continuously exerted on the valve member in a second direction opposite to the first direction; and exerting a biasing force on the valve member in the second direction such that when the first force overcomes the second force and the biasing force combined together, the valve member moves from the first position to the second position and thereby modulates the capacity, wherein the compressor is in fluid communication with a condenser exposed to outside air and the method further comprises the step of selecting the biasing force such that the movable component moves to the second position when the temperature of the outside air is greater than a predetermined temperature.

73. The method of claim 72, wherein the predetermined temperature is in the range of 75 to 94° F.

* * * * *

UNITED STATES PATENT AND TRADEMARK OFFICE

CERTIFICATE OF CORRECTION

PATENT NO. : 6,663,358 B2
DATED : December 16, 2003
INVENTOR(S) : Joe Frank Loprete et al.

It is certified that error appears in the above-identified patent and that said Letters Patent is hereby corrected as shown below:

Column 25,
Line 34, "compressor comprising:" should read -- compressor, comprising: --.

Signed and Sealed this

Twenty-fourth Day of February, 2004

JON W. DUDAS
*Acting Director of the United States Patent and Trademark Office*